US008925346B2

(12) United States Patent
Natarajan et al.

(10) Patent No.: US 8,925,346 B2
(45) Date of Patent: Jan. 6, 2015

(54) HIGH PERFORMANCE FREEZER HAVING CYLINDRICAL CABINET

(75) Inventors: Mahesh Natarajan, Coimbatore (IN); Tushar Ingle, Pune (IN); Rajendra Khadatkar, MadhylPradesh (IN)

(73) Assignee: Thermo Fisher Scientific (Asheville) LLC, Asheville, NC (US)

( * ) Notice: Subject to any disclaimer, the term of this patent is extended or adjusted under 35 U.S.C. 154(b) by 243 days.

(21) Appl. No.: 13/368,032

(22) Filed: Feb. 7, 2012

(65) Prior Publication Data

US 2013/0199232 A1 Aug. 8, 2013

(51) Int. Cl.
*F25D 11/02* (2006.01)

(52) U.S. Cl.
USPC ..... 62/443; 62/335; 62/440; 62/251; 312/408

(58) Field of Classification Search
USPC ..... 62/443, 335, 175, 331, 329, 251; 312/405, 325, 326, 329, 319.1, 319.2, 312/319.5, 319.6, 319.7, 408, 305, 249.2, 312/270.1, 270.2; 49/394; 292/95, 111, 292/121, 194, 219, 222, 224, 197
See application file for complete search history.

(56) References Cited

U.S. PATENT DOCUMENTS

| | | | | | |
|---|---|---|---|---|---|
| 95,477 | A | * | 10/1869 | Hinman | 312/307 |
| 678,612 | A | | 7/1901 | Daemicke | |
| 986,875 | A | | 3/1911 | Tilghman | |
| 1,242,235 | A | | 10/1917 | Polk | |
| 1,462,285 | A | | 7/1923 | Hilger | |
| 1,474,847 | A | | 11/1923 | Philips et al. | |
| 2,030,780 | A | | 2/1936 | Bicknell | |
| 2,207,472 | A | | 7/1940 | Young | |
| 2,402,921 | A | | 6/1946 | Sharpe | |
| 2,462,279 | A | | 2/1949 | Passman | |
| 2,492,648 | A | * | 12/1949 | McCloy | 62/175 |
| 2,498,028 | A | * | 2/1950 | Clerc | 62/284 |
| 2,507,834 | A | | 5/1950 | Storer et al. | |
| 2,588,563 | A | * | 3/1952 | Paul | 62/381 |
| 2,638,400 | A | | 5/1953 | Spotts | |
| 2,722,807 | A | | 11/1955 | Downing | |
| 3,031,055 | A | | 4/1962 | Soule | |
| 3,039,837 | A | * | 6/1962 | Poe | 312/332.1 |
| 3,208,810 | A | * | 9/1965 | Muffly | 312/296 |
| 3,306,068 | A | | 2/1967 | Allgeyer et al. | |
| 3,399,708 | A | | 9/1968 | Usher | |
| 3,552,299 | A | * | 1/1971 | Patoka | 99/339 |

(Continued)

FOREIGN PATENT DOCUMENTS

| | | | | |
|---|---|---|---|---|
| GB | 2180921 | A | 4/1987 | |
| JP | 2275274 | A | 11/1990 | |
| WO | 2009062739 | A1 | 5/2009 | |
| WO | WO 2010039824 | A2 * | 4/2010 | F25D 23/06 |

*Primary Examiner* — Cheryl J Tyler
*Assistant Examiner* — David Teitelbaum
(74) *Attorney, Agent, or Firm* — Wood, Herron & Evans, LLP

(57) ABSTRACT

A high performance freezer includes a deck and a cabinet supported above the deck and having a cabinet housing defining a generally cylindrical shape. The freezer includes a door supported by the cabinet housing that moves between open and closed positions by sliding or pivoting generally along the side wall of the cabinet. The freezer further includes a refrigeration system mounted at least partially within the deck and partially within the cabinet to refrigerate an inner chamber of the freezer. The cylindrical shape of the cabinet enables rotation of shelves within the inner chamber and a maximized storage space with a minimal floor space required.

35 Claims, 15 Drawing Sheets

(56) References Cited

U.S. PATENT DOCUMENTS

| | | | | | |
|---|---|---|---|---|---|
| 3,769,805 | A | | 11/1973 | Corini | |
| 3,797,272 | A | | 3/1974 | Huey | |
| 3,976,459 | A | | 8/1976 | Ames | |
| RE29,621 | E | | 5/1978 | Conley et al. | |
| 4,102,149 | A | | 7/1978 | Conley et al. | |
| 4,317,604 | A | | 3/1982 | Krakauer | |
| 4,498,603 | A | | 2/1985 | Wittenborg | |
| 4,587,908 | A | * | 5/1986 | DeBruyn | 108/142 |
| 4,679,411 | A | | 7/1987 | Pearse, Jr. | |
| 4,787,211 | A | | 11/1988 | Shaw | |
| 4,831,841 | A | | 5/1989 | Falk | |
| 4,927,051 | A | | 5/1990 | Falk et al. | |
| 4,951,475 | A | | 8/1990 | Alsenz | |
| 5,058,393 | A | | 10/1991 | Callon et al. | |
| 5,079,929 | A | | 1/1992 | Alsenz | |
| 5,095,712 | A | | 3/1992 | Narreau | |
| 5,142,872 | A | | 9/1992 | Tipton | |
| 5,203,179 | A | | 4/1993 | Powell | |
| 5,205,130 | A | | 4/1993 | Pannell | |
| 5,253,483 | A | | 10/1993 | Powell et al. | |
| 5,255,529 | A | | 10/1993 | Powell et al. | |
| 5,265,434 | A | | 11/1993 | Alsenz | |
| 5,277,488 | A | * | 1/1994 | Cleary et al. | 312/408 |
| 5,335,507 | A | | 8/1994 | Powell | |
| 5,360,134 | A | | 11/1994 | Falk et al. | |
| 5,403,079 | A | * | 4/1995 | Fetisoff | 312/204 |
| 5,456,530 | A | * | 10/1995 | Blaize | 312/319.6 |
| 5,458,407 | A | | 10/1995 | Bustos et al. | |
| 5,524,443 | A | | 6/1996 | Frank | |
| 5,586,444 | A | | 12/1996 | Fung | |
| 5,694,780 | A | | 12/1997 | Alsenz | |
| 5,797,279 | A | | 8/1998 | Osborne | |
| 5,927,088 | A | | 7/1999 | Shaw | |
| 6,131,399 | A | | 10/2000 | Hall | |
| 6,131,401 | A | | 10/2000 | Ueno et al. | |
| 6,237,356 | B1 | | 5/2001 | Hori et al. | |
| 6,327,867 | B1 | | 12/2001 | Hyodo et al. | |
| 6,453,691 | B1 | | 9/2002 | Seo et al. | |
| 6,494,054 | B1 | | 12/2002 | Wong et al. | |
| 6,595,009 | B1 | | 7/2003 | Howard et al. | |
| 6,688,123 | B2 | | 2/2004 | Felder et al. | |
| 6,766,652 | B2 | | 7/2004 | Kelly et al. | |
| 6,986,262 | B2 | | 1/2006 | Takasugi et al. | |
| 6,990,828 | B2 | | 1/2006 | Kim et al. | |
| 7,086,198 | B2 | | 8/2006 | Hayden | |
| 7,096,681 | B2 | | 8/2006 | Wills et al. | |
| 7,178,202 | B2 | * | 2/2007 | Hirtsiefer et al. | 16/366 |
| 7,193,826 | B2 | | 3/2007 | Crane et al. | |
| 7,207,183 | B2 | | 4/2007 | Crane et al. | |
| 7,231,773 | B2 | | 6/2007 | Crane et al. | |
| 7,234,320 | B2 | | 6/2007 | Fee et al. | |
| 7,251,954 | B2 | | 8/2007 | Fee et al. | |
| 7,310,953 | B2 | | 12/2007 | Pham et al. | |
| 7,747,347 | B2 | | 6/2010 | Park, IV | |
| 7,784,888 | B2 | * | 8/2010 | Oh et al. | 312/223.6 |
| 8,011,201 | B2 | | 9/2011 | Brown et al. | |
| 2001/0039762 | A1 | * | 11/2001 | Giovannetti | 49/246 |
| 2004/0118139 | A1 | | 6/2004 | Kelly et al. | |
| 2005/0252226 | A1 | | 11/2005 | Seefeldt | |
| 2006/0225445 | A1 | | 10/2006 | Lifson et al. | |
| 2007/0156032 | A1 | | 7/2007 | Gordon et al. | |
| 2007/0276637 | A1 | | 11/2007 | Allen et al. | |
| 2008/0014097 | A1 | | 1/2008 | Hase et al. | |
| 2008/0041076 | A1 | | 2/2008 | Tutunoglu et al. | |
| 2008/0066481 | A1 | * | 3/2008 | An et al. | 62/265 |
| 2008/0148965 | A1 | | 6/2008 | Bravo et al. | |
| 2008/0156031 | A1 | | 7/2008 | Cur et al. | |
| 2008/0189906 | A1 | * | 8/2008 | Resnik et al. | 16/54 |
| 2009/0126901 | A1 | | 5/2009 | Hegar et al. | |
| 2009/0188272 | A1 | | 7/2009 | Cloutier et al. | |
| 2009/0236954 | A1 | * | 9/2009 | Kobayashi et al. | 312/36 |
| 2010/0064717 | A1 | | 3/2010 | Burn | |
| 2010/0219730 | A1 | * | 9/2010 | Watts et al. | 312/404 |
| 2011/0005264 | A1 | * | 1/2011 | Lee et al. | 62/449 |

* cited by examiner

HIGH PERFORMANCE FREEZER HAVING CYLINDRICAL CABINET

FIELD OF THE INVENTION

The present invention relates generally to freezers and, more particularly, to high performance freezers operable to cool an inner chamber to a range from about −30° C. to about −80° C., or lower.

BACKGROUND OF THE INVENTION

Refrigeration systems are known for use with laboratory refrigerators and freezers of the type known as "high performance freezers," which are used to cool their interior storage spaces to relatively low temperatures such as about −30° C. or lower, for example. One type of high performance freezer is known as an "ultra-low temperature freezer" ("ULT"), which is used to cool its inner storage chamber to relatively low temperatures such as about −80° C. or lower, for example.

Known refrigeration systems of this type include two stages circulating respective first and second refrigerants. The first stage receives energy (i.e., heat) from the cooled space (e.g., a cabinet inner chamber) through an evaporator circulating the first refrigerant, while the second refrigerant of the second stage transfers heat energy to the surrounding environment. Heat is transferred from the first refrigerant to the second refrigerant through a heat exchanger that is in fluid communication with the two stages of the refrigeration system. Alternatively, other known refrigeration systems used with high performance freezers only include one refrigeration stage with a condenser and an evaporator, such as when the cooling requirements in the freezer are less demanding.

In order to maximize a cooled space within these high performance freezers, the freezer has been provided with a rectangular box shaped cabinet. These box shaped cabinets include a door along at least one side wall for providing access into the inner chamber of the cabinet. Conventional doors are generally pivotally coupled to the cabinet and therefore require significant floor space or clearance to fully open the door. Additionally, opening these pivotal doors generally exposes the entire inner chamber to the exterior environment for the duration of the door opening. Especially when using a two-stage cascade refrigeration system in an ultra-low temperature freezer, exposing the entire inner chamber to the exterior environment adds significant heat energy into the inner chamber that requires a relatively lengthy period of time for the refrigeration system to recover to a desired temperature following the door re-closing.

Furthermore, it can be difficult to access items stored in the back of the inner chamber of these rectangular box shaped freezers. Even when improvements such as slide-out storage racks are provided in the cabinet to permit easier access to such stored items, the movement and replacing of these storage racks increases the total time that the door is opened and the inner chamber is exposed to the exterior environment. As described above, this arrangement therefore increases the amount of time that the refrigeration system requires to establish a desired temperature within the inner chamber.

There is a need, therefore, for a freezer that reduces the floor space required for the freezer and that improves the accessibility of items stored in all locations within the cabinet of the freezer.

SUMMARY OF THE INVENTION

In one embodiment according to the present invention, a freezer includes a deck and a cabinet supported above the deck. The cabinet includes a cabinet housing and a chamber wall located within the cabinet housing and defining an inner chamber. The cabinet housing has a generally cylindrical shape along its length and includes an outer opening for providing access to the inner chamber. The freezer also includes a door supported by the cabinet housing, the door being configured to move between open and closed positions relative to the outer opening. The freezer further includes a refrigeration system mounted at least partially within the deck. The refrigeration system includes a first refrigeration stage defining a first fluid circuit for circulating a first refrigerant. The first refrigeration stage has a first compressor, a first expansion device, and an evaporator in fluid communication with the first fluid circuit. The evaporator is in thermal communication with the chamber wall to refrigerate the inner chamber.

In one aspect, the refrigeration system is a two-stage cascade refrigeration system that includes a second refrigeration stage defining a second fluid circuit for circulating a second refrigerant. The second refrigeration stage includes a second compressor, a condenser, and a second expansion device in fluid communication with the second fluid circuit. The refrigeration system of this aspect also includes a heat exchanger in fluid communication with the first and second fluid circuits, such that the freezer operates as an ultra-low temperature freezer and provides a temperature within the inner chamber in a range from about −30° C. to about −80° C. In another aspect, the inner chamber includes a top wall, a bottom wall, and a side wall, and the evaporator is located adjacent to each of the top wall, the bottom wall, and the side wall. More particularly, the evaporator includes an evaporator coil that follows a sinusoidal pattern adjacent to the side wall and follows a coil pattern adjacent to each of the top and bottom walls.

The freezer may further include a latch mechanism configured to lock the door in the closed position or unlock the door to enable movement of the door to the open position. The latch mechanism includes a spring-biased cam latch coupled to the door and a pin follower coupled to the cabinet housing. The cam latch engages the pin follower to lock the door in the closed position. In these embodiments, the door includes a handle coupled to the cam latch that moves the cam latch out of engagement with the pin follower against the spring bias when the door is to be moved from the closed position to the open position. The door may also include a sealing gasket proximate the outer opening. The sealing gasket compresses into sealed engagement with the door and the cabinet housing when the latch mechanism locks the door in the closed position, and the sealing gasket expands when the cam latch is disengaged from the pin follower so as to begin movement of the door towards the open position.

In another aspect, the freezer further includes first and second links pivotally coupled to the door and to the cabinet housing. To this end, the door pivotally moves along a cylindrical side wall of the cabinet housing during travel of the door between the open and closed positions. At least one of the links may be coupled to a door motor for driving the door between the open and closed positions. In this arrangement, the door includes a user interface panel operatively coupled to the door motor for controlling operation of the door motor. The user interface panel is electrically connected to a power supply by a cord extending from the door into the cabinet housing via a cord guard that extends and retracts within the cabinet housing as the door moves.

In yet another aspect, the door includes a plurality of doors movable between open and closed positions to provide access to different portions of the inner chamber. Each of the plurality of doors is moveable independent of the other doors. For example, each of the plurality of doors may be slidable along a side wall of the cabinet housing.

In some embodiments, the refrigerator includes an upstanding, elongated shaft located within the inner chamber and a plurality of vertically spaced rotatable shelves operatively coupled to the shaft. Each of the plurality of shelves is removably supported by the chamber wall so that each shelf is vertically adjustable within the inner chamber. More specifically, a side wall of the chamber wall includes a plurality of pin apertures, and each shelf is rotatably supported on roller bearings including pins inserted into the corresponding pin apertures in the chamber wall. Each of the shelves is independently rotatable with respect to the other shelves.

In one aspect, the shelves are driven to rotate by a shelf motor operatively coupled to the elongated shaft. To this end, the elongated shaft may include an electromagnetic clutch member associated with each of the shelves and an armature connected to each of the shelves. A controller operates the shelf motor to rotate the elongated shaft and operates one or more of the electromagnetic clutch members to connect the rotating elongated shaft to the corresponding shelves to be rotated. In embodiments where a user interface panel is provided on the door, the controller may be configured to receive information from the user interface panel about an article to be retrieved from the inner chamber, and then rotate the particular shelf on which the article is located to a position easily accessible through the door. The freezer may also include an optical sensor operatively coupled to the controller for indexing the rotation of the elongated shaft and thus also the shelves within the inner chamber.

In yet another aspect, the freezer includes a plurality of vertically oriented dividers extending radially outwardly from adjacent the elongated shaft so as to divide the plurality of shelves into a plurality of shelf compartments. These vertically oriented dividers may be positioned to provide selective access to one of the shelf compartments in a particular shelf when the door of the freezer is opened, while blocking access to adjacent shelf compartments on the particular shelf. Additionally, a plurality of racks is insertable into each shelf compartment to further increase storage configurations and capacity within the freezer.

In another embodiment according to the present invention, a freezer includes a deck and a cabinet supported above the deck. The cabinet includes a cabinet housing and a chamber wall located within the cabinet housing and defining an inner chamber. The cabinet housing has a generally cylindrical shape along its length and includes an outer opening for providing access to the inner chamber. The freezer also includes a door supported by the cabinet housing, the door being configured to move between open and closed positions relative to the outer opening. The freezer further includes first and second links pivotally coupled to the door and to the cabinet housing such that the door pivotally moves along the side wall of the cabinet housing during travel of the door between the open and closed positions. A refrigeration system is mounted at least partially within the deck for refrigerating the inner chamber.

These and other objects and advantages of the present invention will become more readily apparent during the following detailed description taken in conjunction with the drawings herein.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
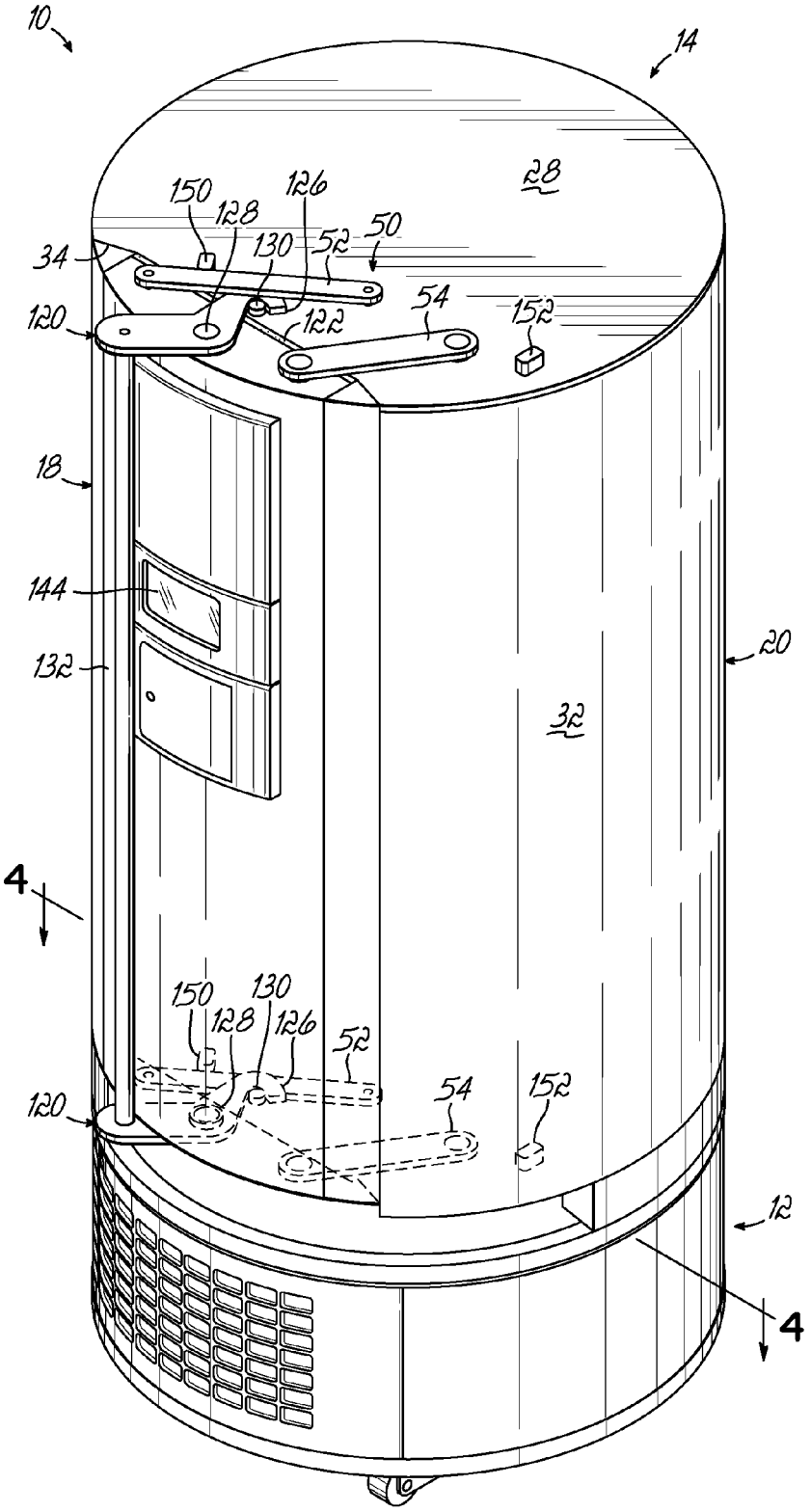
FIG. 1 is a perspective view of a freezer including a cylindrical cabinet according to an exemplary embodiment of the present invention.
Figure 2:
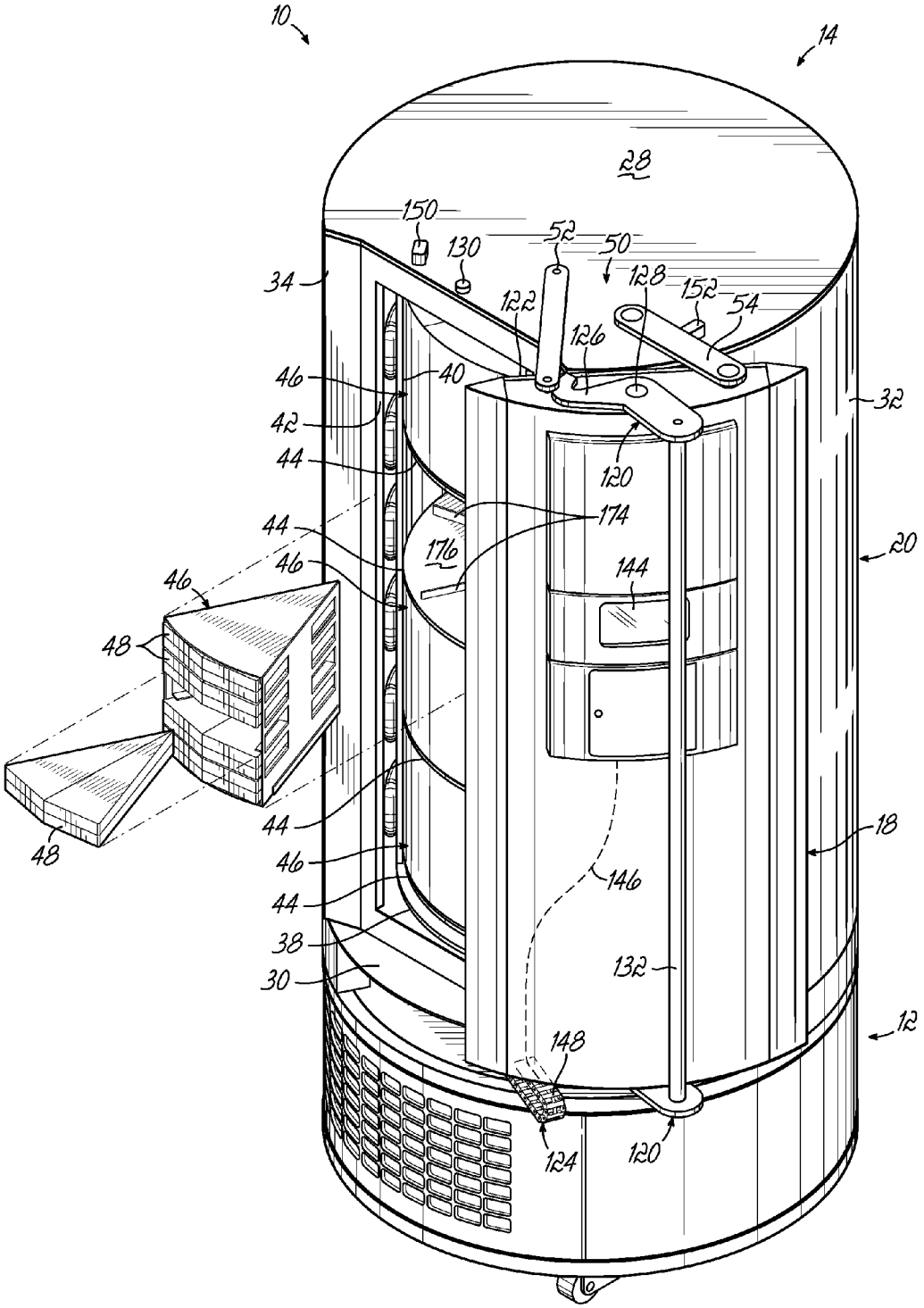
FIG. 2 is a perspective view of the freezer of FIG. 1 with a door opened and a rack being removed.

With reference to the figures, and more specifically to FIGS. 1-15, an exemplary freezer 10 according to one embodiment of the present invention is illustrated. Although the terms "high performance freezer" and "freezer" are used throughout the specification, it will be understood that these terms encompass any type of cooling device, refrigerator, or freezer. The freezer 10 of FIGS. 1 and 2 is in the form of an ultra-low temperature freezer ("ULT") 10 including a deck 12 that supports a cabinet 14 above the deck 12. As used herein, the term "deck" refers to the structural assembly or framework that is located beneath and supports the cabinet 14. The freezer 10 stores items that require cooling to a desired temperature in the range from about −30° C. to about −80° C., or even lower temperatures, for example. In this regard, the freezer 10 includes a two-stage cascade refrigeration system 16 that cools items stored in the freezer 10 to the desired temperature. Components of the cascade refrigeration system 16 are located in the deck 12 and in the cabinet 14. Advantageously, the cabinet 14 defines a cylindrical shape for the freezer 10. As a result, the storage space within the cabinet 14 is maximized with respect to the total floor space necessary for the freezer 10. Although the deck 12 is shown with a cylindrical shape in this embodiment, it will be understood that the deck 12 may define other shapes such as rectangular in other embodiments consistent with the present invention.

Figure 3:
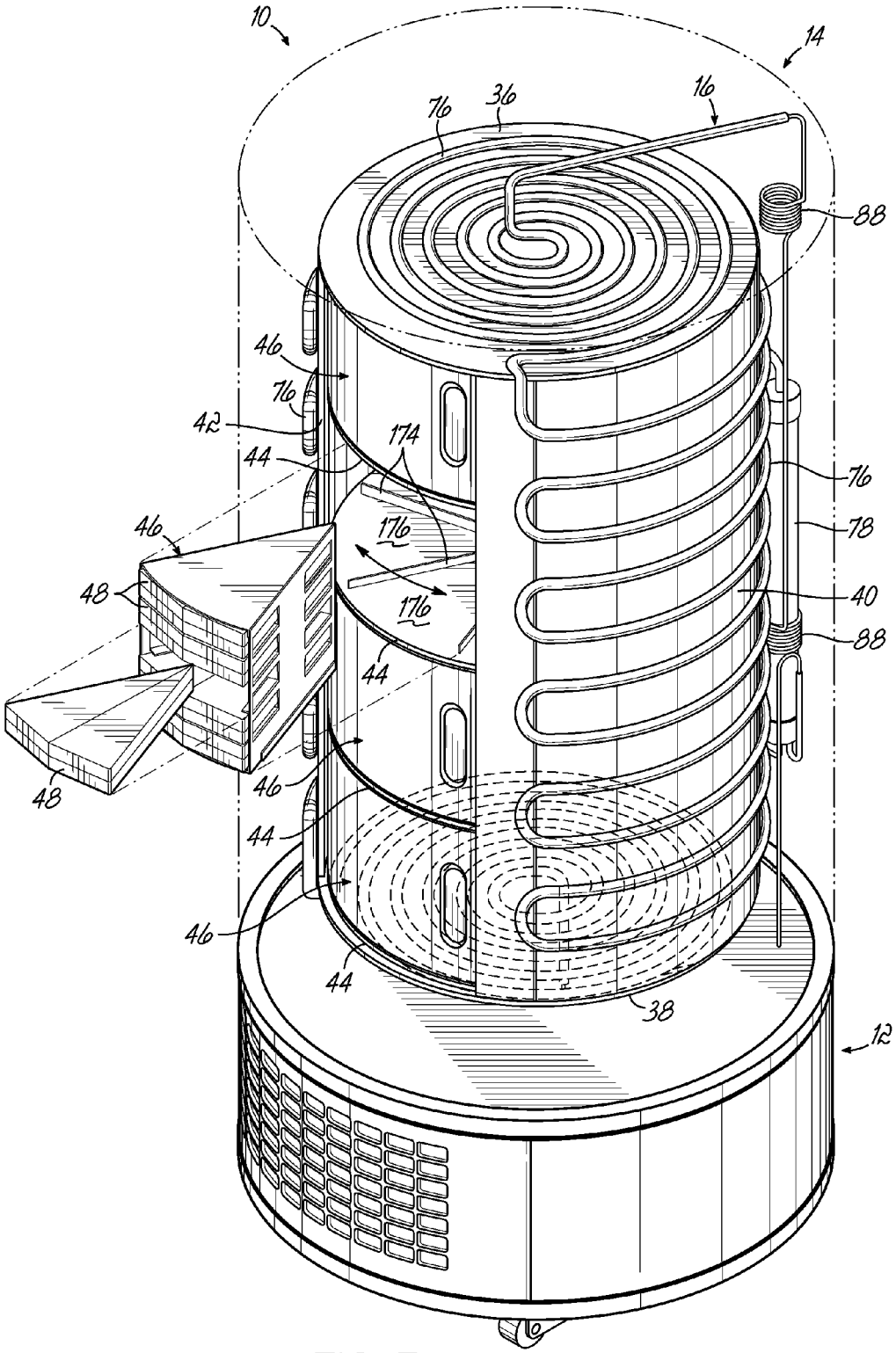
FIG. 3 is a perspective view of the freezer of FIG. 1 with an outer cabinet housing shown in phantom so as to illustrate the evaporator coil wrapped about an inner chamber.

The freezer 10 includes an arcuate door 18 configured to move from the closed position shown in FIG. 1 to an open position shown in FIG. 2 to provide access into the cabinet 14. The door 18 includes a pressure equalization port 19 that selectively enables any pressure difference between the interior of the cabinet 14 and the external environment to be equalized just in advance of the door 18 being opened. More particularly, and as shown in FIGS. 1-3, the cabinet 14 includes an outer cabinet housing 20 and an inner chamber wall 22 located within the outer cabinet housing 20. The outer cabinet housing 20 and the inner chamber wall 22 are separated by an insulated space 24 around each side of an inner chamber 26 defined by the inner chamber wall 22. The inner chamber 26 is cooled by the cascade refrigeration system 16 to very low temperatures, so the insulated space 24 is provided to insulate the inner chamber wall 22 and the inner chamber 26 from the outer cabinet housing 20 and the environment external to the freezer 10. As will be readily understood, the insulated space 24 is generally filled with an insulating material such as expanding foamed insulation (not shown) to provide a reliable barrier to heat transfer into the inner chamber 26. However, as described below, several components of the cascade refrigeration system 16 are also located within the insulated space 24 of the cabinet 14.

As shown most clearly in FIGS. 1-3, the outer cabinet housing 20 of the cabinet 14 includes a top panel 28, a bottom panel 30 adjacent the deck 12, and a side panel 32 having a generally cylindrical shape and extending between the top and bottom panels 28, 30. The side panel 32 is interrupted at an outer opening 34 configured to provide access to the inner chamber 26 when the door 18 is moved away from the outer opening 34. Similarly, the inner chamber wall 22 includes a top wall 36 adjacent the top panel 28, a bottom wall 38 adjacent the bottom panel 30, and a side wall 40 extending in generally cylindrical fashion between the top and bottom walls 36, 38. The side wall 40 includes an inner opening 42 aligned with the outer opening 34 such that when the door 18 is moved to the open position, the inner chamber 26 is exposed to the exterior environment via the outer opening 34 and the inner opening 42. When the door 18 is opened as shown in FIG. 2, access is provided to a plurality of rotatable shelves 44 located within the inner chamber 26. Each of the rotatable shelves 44 is configured to receive a plurality of pie-shaped racks 46 that hold one or more cassettes 48 for holding samples or other items to be stored within the freezer 10 in the embodiment shown. The plurality of shelves 44 and pie-shaped racks 46 are described in further detail below. The rotatable shelves 44 within the cylindrical cabinet 14 improve the accessibility of articles stored in all locations on the shelves 44 because a user does not have to reach through the majority of the inner chamber 26 to obtain a stored article.

With continued reference to FIGS. 1-3, the door 18 advantageously pivots to move generally circumferentially along the outer cabinet housing 20 rather than rotating in a wide arc away from the outer cabinet housing 20. Thus pivotal movement of the door 18 is enabled by a door linkage 50 coupled to the top panel 28 of the cabinet 14 and to the door 18. The door linkage 50 includes a first link 52 and a second link 54 each pivotally coupled to each of the door 18 and the cabinet 14. The door 18 moves by pivoting both the first and second links 52, 54 in accordance with the principals of a four bar linkage (the cabinet 14 effectively defining a fixed fourth "link"). As a result, the door 18 movement approximates a sliding circumferential movement along the side panel 32 of the outer cabinet housing 20 rather than a wide rotation about a fixed pivot point. Accordingly, the opening and closing movement of the door 18 does not require much floor space or clearance beyond that floor space required for the cabinet 14 and deck 12. To this end, the floor space required for full operational capability of the freezer 10 is minimized.

As briefly noted above, the deck 12 and the cabinet 14 support a plurality of components that jointly define the cascade refrigeration system 16 that thermally interacts with the cabinet 14 to cool the inner chamber 26. An exemplary refrigeration system similar to the cascade refrigeration system 16 is described in U.S. Pat. No. 8,011,201 to Brown et al., entitled "Refrigeration System Mounted within a Deck," which is assigned to the assignee of the present application and is incorporated by reference herein in its entirety. However, the cascade refrigeration system 16 of this invention includes additional advantageous features described in further detail below.

Figure 3A:
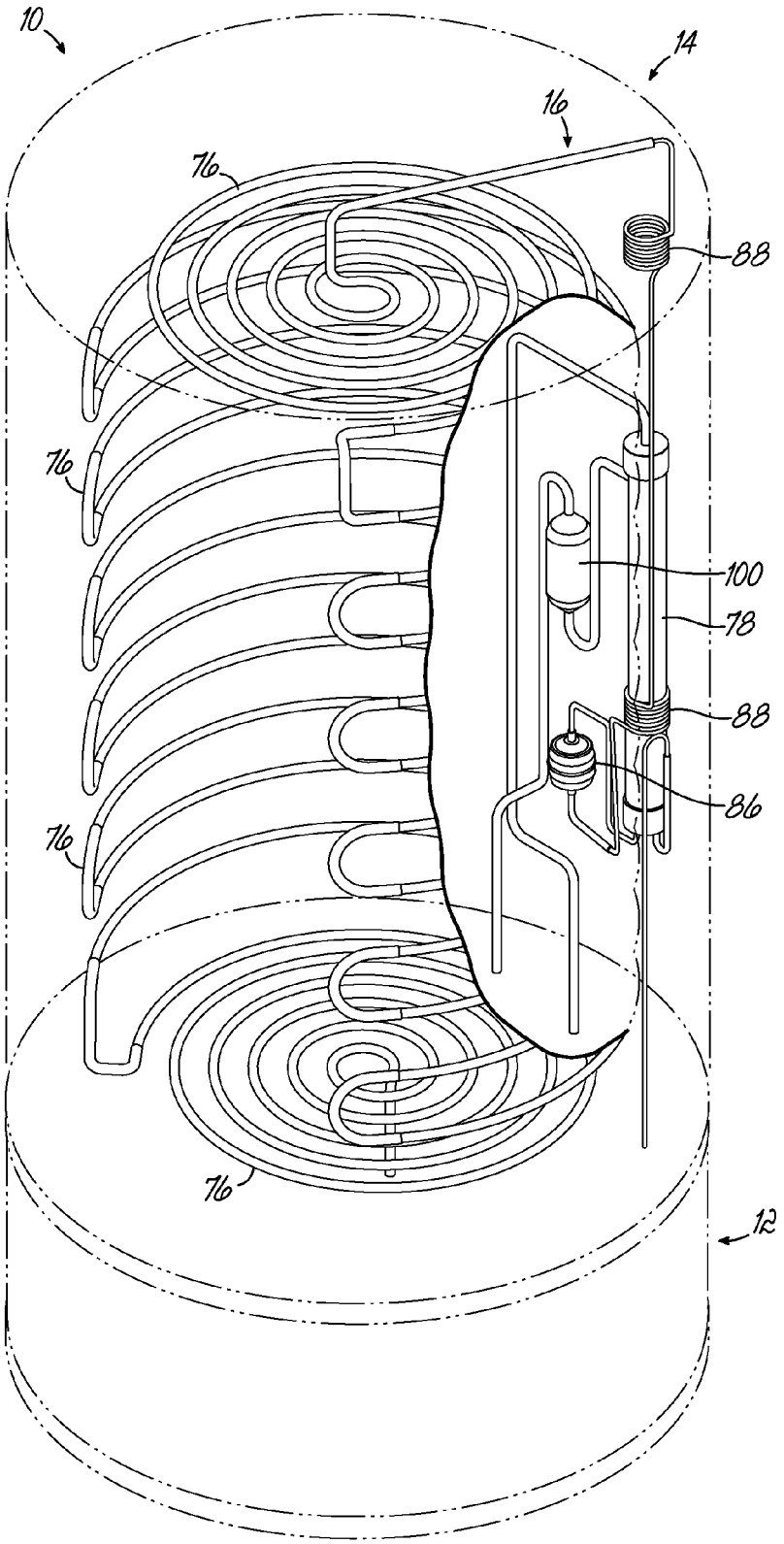
FIG. 3A is a perspective view of the evaporator coil of FIG. 3.
Figure 4:
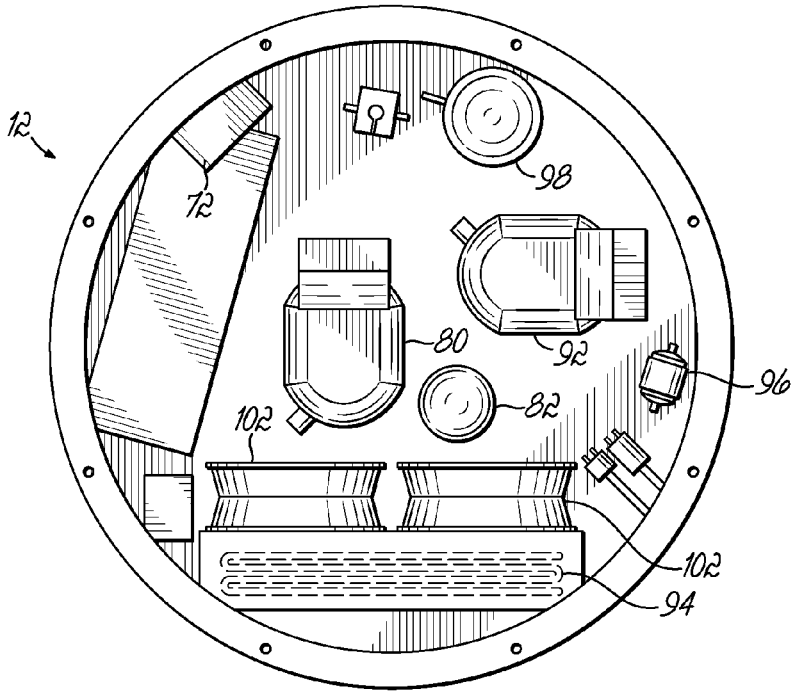
FIG. 4 is a top view of a deck of the freezer of FIG. 1.
Figure 10:
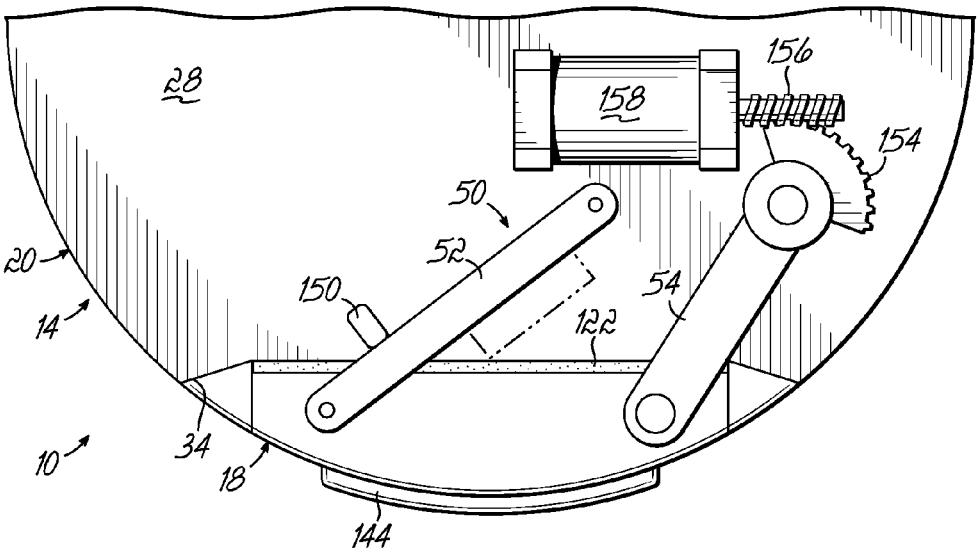
FIG. 10 is a top view of an alternative embodiment of an upper door drive mechanism used with the freezer of FIG. 1.
Figure 5:
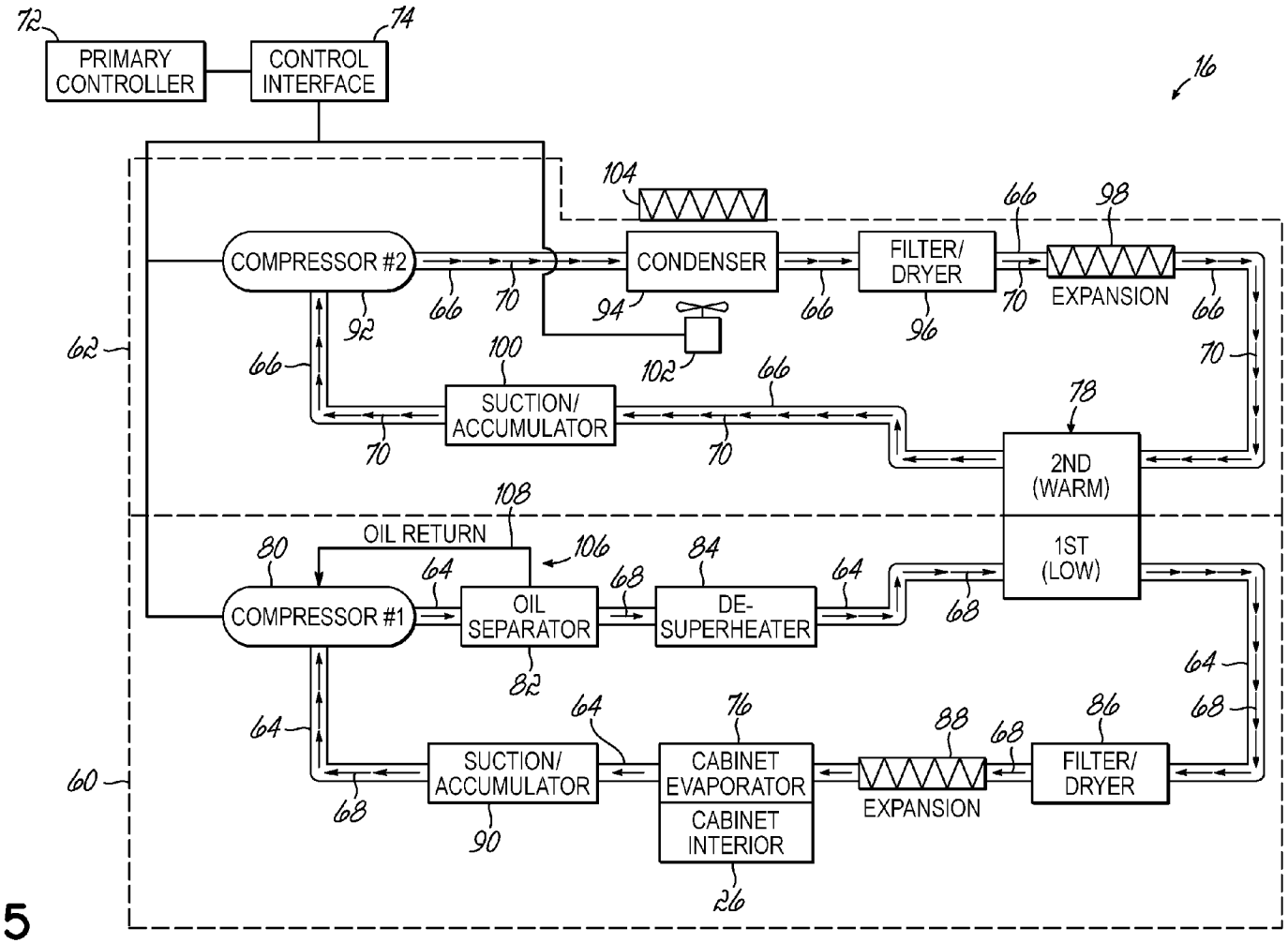
FIG. 5 is a schematic system view of a two stage refrigeration system used with the freezer of FIG. 1.
Figure 6:
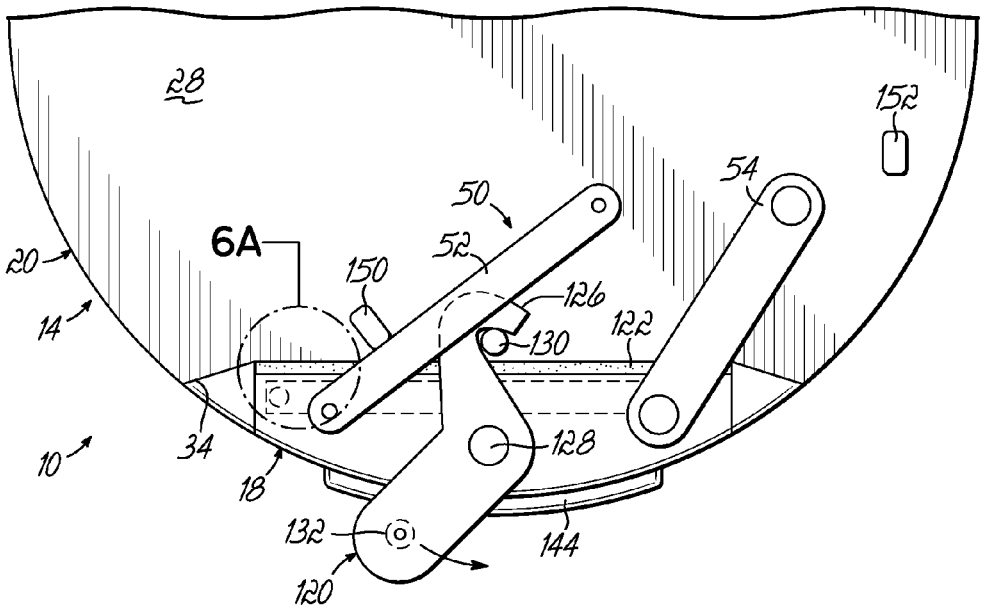
FIG. 6 is a top view of a door locking latch and a door linkage of the freezer of FIG. 1, with the locking latch in a locked position.

With reference to FIGS. 3-5, details of the exemplary cascade refrigeration system 16 are illustrated. More specifically, FIGS. 3, 3A, and 4 illustrate various components of the refrigeration system 16 as positioned within the deck 12 and the cabinet 14, while FIG. 5 illustrates a schematic representation of the refrigeration system 16. As shown in these Figures, the refrigeration system 16 is made up of a first stage 60 and a second stage 62 respectively defining first and second fluid circuits 64, 66 for circulating a first refrigerant 68 and a second refrigerant 70. Although not shown in these figures, a plurality of sensors may be arranged at the various components of the refrigeration system 16 to sense different operating conditions of the refrigeration system 16 and/or properties of the refrigerants 68, 70 in the system 16. Additionally, a controller 72 accessible through a controller interface 74 controls the operation of the refrigeration system 16 based at least in part on readings from these various sensors. The first stage 60 receives energy (i.e., heat) from the inner chamber 26 through an evaporator 76 circulating the first refrigerant 68, while the second refrigerant 70 of the second stage 62 transfers heat energy to the surrounding environment. Heat is transferred from the first refrigerant 68 to the second refrigerant 70 through a heat exchanger 78 that is in fluid communication with the first and second fluid circuits 64, 66 of the refrigeration system 16.

With continued reference to FIG. 5, the first stage 60 includes, in sequence, a first compressor 80, an oil separator 82, a de-superheater 84, the heat exchanger 78, a first filter/dryer device 86, a first expansion device 88, the evaporator 76, and a first suction accumulator device 90. The second stage 62 includes, also in sequence, a second compressor 92, a condenser 94, a second filter/dryer device 96, a second expansion device 98, the heat exchanger 78, and a second suction accumulator device 100. A fan 102 directs ambient air across the condenser 94 through a filter 104 and facilitates the transfer of heat from the second refrigerant 70 to the surrounding environment.

The evaporator 76 is in thermal communication with the inner chamber 26 via the inner chamber wall 22 (FIG. 3) such that heat is transferred from the inner chamber 26 to the evaporator 76, thereby cooling the inner chamber 26. The heat exchanger 78 is in fluid communication with the first fluid circuit 64 between the de-superheater 84 and the first filter/dryer 86. The heat exchanger 78 is also in fluid communication with the second fluid circuit 66 between the second expansion device 98 and the second suction/accumulator device 100. In general, the second refrigerant 70 is condensed in the condenser 94 and remains in liquid phase until it evaporates at some point within the heat exchanger 78. The first refrigerant 68 is evaporated in the evaporator 76 and remains in gaseous phase until it condenses at some point within the heat exchanger 78. In this regard, the refrigeration system 16 transfers heat from the inner chamber 26 through the first refrigerant 68, the heat exchanger 78, and the second refrigerant 70 to the external environment.

In operation, the first refrigerant 68 receives heat from the inner chamber 26 through the evaporator 76 and flows from the evaporator 76 to the first suction accumulator device 90. The first suction accumulator device 90 collects gaseous phase and excessive liquid phase first refrigerant 68 and passes it at a controlled rate to the first compressor 80. From the first compressor 80, the compressed first refrigerant 68 flows into the oil separator 82, which is a part of an oil loop 106 defined in the first stage 60. The oil loop 106 includes the oil separator 82 and an oil return line 108 directing oil back into the first compressor 80. Additionally, or alternatively, the first refrigerant 68 then passes from the oil separator 82 to the de-superheater 84, which cools down the discharge stream of the first refrigerant 68.

The first refrigerant 68 then travels from the de-superheater 84 into the heat exchanger 78 thermally communicating the first and second fluid circuits 64, 66 with one another. The first refrigerant 68 enters the heat exchanger 78 in gaseous form and transfers heat to the second refrigerant 70 while condensing into a liquid form. In this regard, the flow of the first refrigerant 68 may, for example, be counter-flow relative to the second refrigerant 70, so as to maximize the rate of heat transfer. In one specific, non-limiting example, the heat exchanger 78 is in the form of a counter-flow tube-in-tube heat exchanger 78, vertically oriented within the insulated space 24 of the cabinet 14 (FIG. 3), with one tube coiled within the other tube to maximize the surface area between the first and second refrigerants 68, 70 within the heat exchanger 78, which in turn maximizes the heat transfer from the first refrigerant 68 to the second refrigerant 70. It will be understood that other types or configurations of heat exchangers are possible as well, such as the split-flow heat exchanger described in U.S. Pat. No. 8,011,201 to Brown, described above. In this regard, the cascade refrigeration system 16 may include a split-flow heat exchanger located in a cold box in the deck 12, as described in U.S. Pat. No. 8,011,201, or within the insulated space 24 within the cabinet 14, as described in U.S. Patent Application No. 61/564,333 (filed Nov. 29, 2011, currently pending), the disclosures of which are hereby incorporated by reference in their entireties. With continued reference to FIGS. 3-5, the first refrigerant 68 exits the heat exchanger 78, in liquid form, and flows through the first filter/dryer device 86, through the first expansion device 88, and then back to the evaporator 76. The first refrigerant 68 evaporates into gaseous form in the evaporator 76 while absorbing heat from the inner chamber 26.

Similarly, the second refrigerant 70 receives heat from the first refrigerant 68 flowing through the heat exchanger 78 and leaves the heat exchanger 78 in gaseous form. The second refrigerant 70 then passes to the second suction accumulator device 100, which passes gaseous form refrigerant and accumulates excessive liquid form refrigerant for controlled rate delivery to the second compressor 92. From the second compressor 92, the compressed second refrigerant 70 flows into the condenser 94. The second refrigerant 70 in the condenser 94 transfers heat to the surrounding environment as it condenses from gaseous to liquid form. The second refrigerant 70 then flows to the second filter/dryer device 96 and to the second expansion device 98, where the second refrigerant 70 undergoes a pressure drop. From the second expansion device 98, the second refrigerant 70 flows back into the heat exchanger 78, entering the same in liquid form.

With reference to FIGS. 3, 3A, and 4, several of the various components and conduits of the cascade refrigeration system 16 described above in connection with the schematic view of FIG. 5 are shown in position in the freezer 10. Advantageously, the heat exchanger 78 and other components are located within the insulated space 24 between the outer cabinet housing 20 and the inner chamber wall 22 of the cabinet 14. The heat exchanger 78 operates at a temperature between the exterior temperature and a desired temperature in the inner chamber 26, so the heat exchanger 78 is positioned so as to be spaced from the outer cabinet housing 20, which is at the exterior temperature, and from the inner chamber wall 22, which is at the desired temperature. By providing the heat exchanger 78 and other components of the refrigeration system 16 within the insulated space 24 in the cabinet 14, the amount of room necessary in the deck 12 may be minimized (e.g., the room within the inner chamber 26 for storing items is further maximized). Additionally, no additional insulated compartment or box is necessary within the deck 12. It will be understood that while FIGS. 3, 3A, and 4 illustrate one arrangement of the components of the refrigeration system 16, these components may be repositioned in any number of manners consistent with the scope of the present invention, such as, for example, positioning the heat exchanger 78 within a cold box in the deck 12 as described above.

Turning specifically to FIGS. 3 and 3A, one example of how the various components of the refrigeration system 16 are contained within the cabinet 14 is shown. Each of these components is located in the insulated space 24 between the outer cabinet housing 20 and the inner chamber wall 22. In this regard, the insulated space 24 may contain the heat exchanger 78, the first filter/dryer device 86, the first expansion device 88, the evaporator 76, and the second suction/accumulator device 100. Conduits of the first and second fluid circuits 64, 66 extend from these components into and out of the deck 12. In this regard, the first and second refrigerants 68, 70 thus each loop into and out of each of the deck 12 and the insulated space 24 in the cabinet 14 during operation of the refrigeration system 16.

As shown schematically in FIGS. 3 and 3A, the first expansion device 88 is in the form of a capillary tube, although it is contemplated that the expansion devices 88, 98 could instead take another form such as, and without limitation, an expansion valve (not shown). The evaporator 76 is in thermal communication with the inner chamber wall 22 as a result of being wrapped around the inner chamber wall 22 as shown in FIGS. 3 and 3A. More particularly, the evaporator 76 is wrapped in coils so as to follow a spiral or coiling pattern along the top wall 36 and the bottom wall 38 and follow a sinusoidal pattern along the side wall 40. The pattern defined by the evaporator 76 may be modified in other embodiments of the present invention.

Turning to the schematic representation of FIG. 4, the deck 12 contains the second compressor 92, the condenser 94 and fan 102, the second filter/dryer device 96, the second expansion device 98, the first compressor 80, the oil separator 82, and the de-superheater (not shown in FIG. 4). Similar to the conduits in the cabinet 14 described above, conduits of the first and second fluid circuits 64, 66 extend from these components into and out of the cabinet 14. Advantageously, none of the components in the deck 12 require special insulation from the external environment, which means that substantially all thermal insulation necessary in the freezer 10 can be used on the cabinet 14. It will be appreciated that the components of the refrigeration system 16 may be moved between the deck 12 and the cabinet 14 in nearly any configuration in other embodiments without departing from the scope of the present invention.

Exemplary refrigerants suitable for the presently described embodiment of the refrigeration system 16 include refrigerants commercially available under the respective designations R404A for the second refrigerant 70, and a mixture of R290 and R508B for the first refrigerant 68. Moreover, in specific embodiments, the first and second refrigerants 68, 70 may be combined with an oil to facilitate lubrication of the respective compressors 80, 92. For example, and without limitation, the second refrigerant 70 may be combined with Mobil EAL Arctic 32 oil and the first refrigerant 68 may be combined with Zerol 150 Alkylbenzene oil. In another aspect of the invention, the precise arrangement of the components illustrated in the figures is intended to be merely exemplary rather than limiting.

Further details of the door 18 and the associated door linkage 50 are shown with reference to FIGS. 6-10. More specifically, the door 18 is shown in a closed and latched position in FIG. 6, a slightly open and unlatched position in FIG. 7, and an open position in FIG. 8. In addition to the door linkage 50, the door 18 includes a latch mechanism 120, a sealing gasket 122, and a cord guard 124, as described in further detail below.

Beginning with the latch mechanism 120, the latch mechanism 120 includes a cam latch 126 pivotally coupled to the door 118 at a pivot point 128. The latch mechanism 120 also includes a pin follower 130 fixedly mounted on the top panel 28 of the outer cabinet housing 20. A handle 132 extends from an opposite side of the latch mechanism 120 from the cam latch 126 and extends across the height of the door 18 (see FIG. 1) so that a user can manipulate the latch mechanism 120. The cam latch 126 is biased into the position shown in FIG. 6 by a spring 134 shown more clearly in FIG. 9. The spring 134 is a torsion spring 134 wrapped around the pivot point 128 and including a first arm 136 coupled to the door 18 and a second arm 138 coupled to the cam latch 126. From the position of the first and second arms 136, 138 shown in FIG. 9, the spring biases or forces the cam latch 126 to rotate to the position shown in FIG. 6, i.e., the position configured to lock the door 18 in the closed position. Thus, once the handle 132 is rotated against the bias of spring 134 to disengage the cam latch 126 from the pin follower 130, the door 18 is free to move slightly outwardly from the cabinet 14 and then along the outer cabinet housing 20 as the first and second links 52, 54 rotate. As described above, this movement of the door 18 approximates a sliding circumferential movement along the outer cabinet housing 20 and thus requires significantly less clearance or floor space than a rotating pivoting door.

Figure 7:
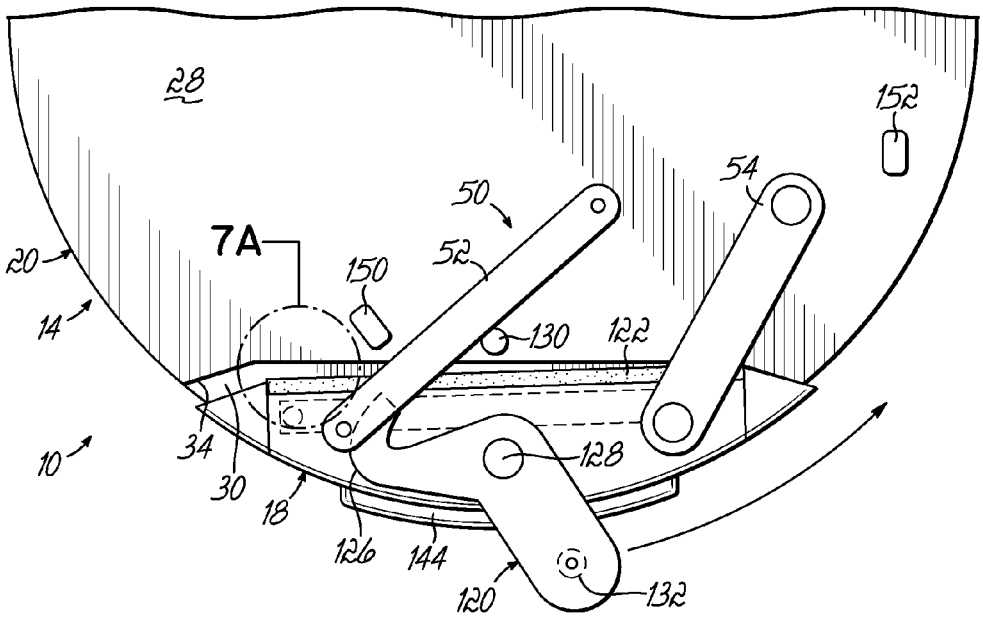
FIG. 7 is a top view of the door locking latch and door linkage of FIG. 6, with the locking latch in an unlocked position.
Figure 6A:
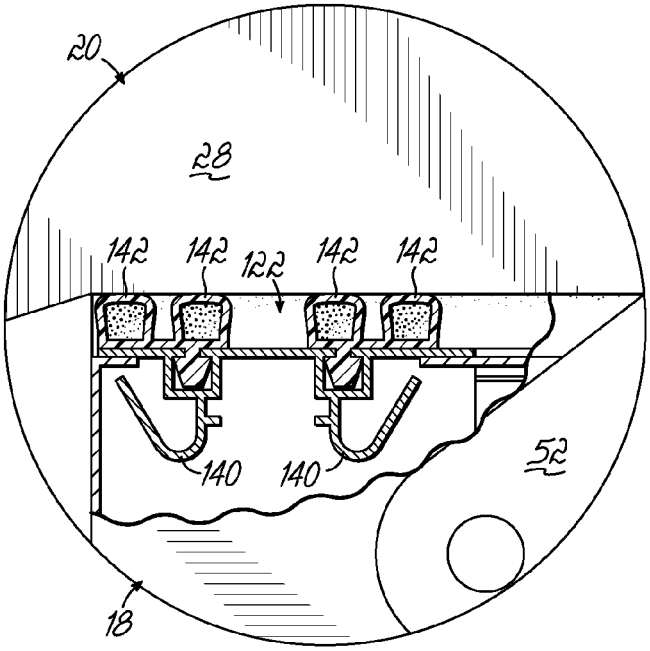
FIG. 6A is a cross-sectional top view of a sealing gasket associated with the door in the locked position of FIG. 6.
Figure 7A:
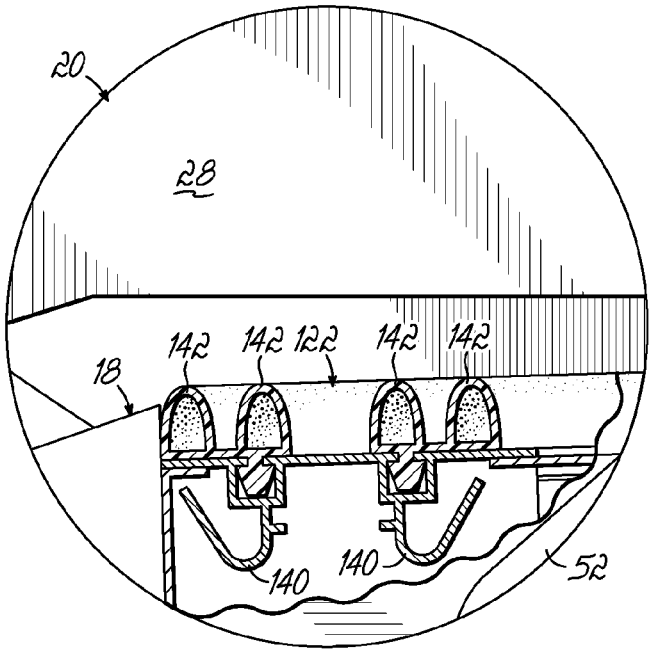
FIG. 7A is a cross-sectional top view of the sealing gasket of FIG. 6A with the door in the unlocked position of FIG. 7.

The sealing gasket 122 is further shown in FIGS. 6A and 7A and includes a breaker 140 and a gasket 142 coupled to the door 18. It will be understood that one or both of the breaker 140 and the compressible gasket 142 could alternatively be positioned on the outer cabinet housing 20 in other embodiments. When the cam latch 126 is engaged with the pin follower 130 in the closed and locked position of FIG. 6, the compressible gasket 142 is compressed between the door 18 and the outer cabinet housing 20 as shown in FIG. 6A, thereby sealing the cabinet 14 at the outer opening 34. When the cam latch 126 is disengaged from the pin follower 130 as shown in FIG. 7, the compressible gasket 142 automatically expands to an uncompressed state as shown in FIG. 7A, thereby moving the door 18 slightly away from the outer cabinet housing 20. In this regard, the sealing gasket 138 assists with beginning to move the door 18 from the closed position to the open position.

Figure 8:
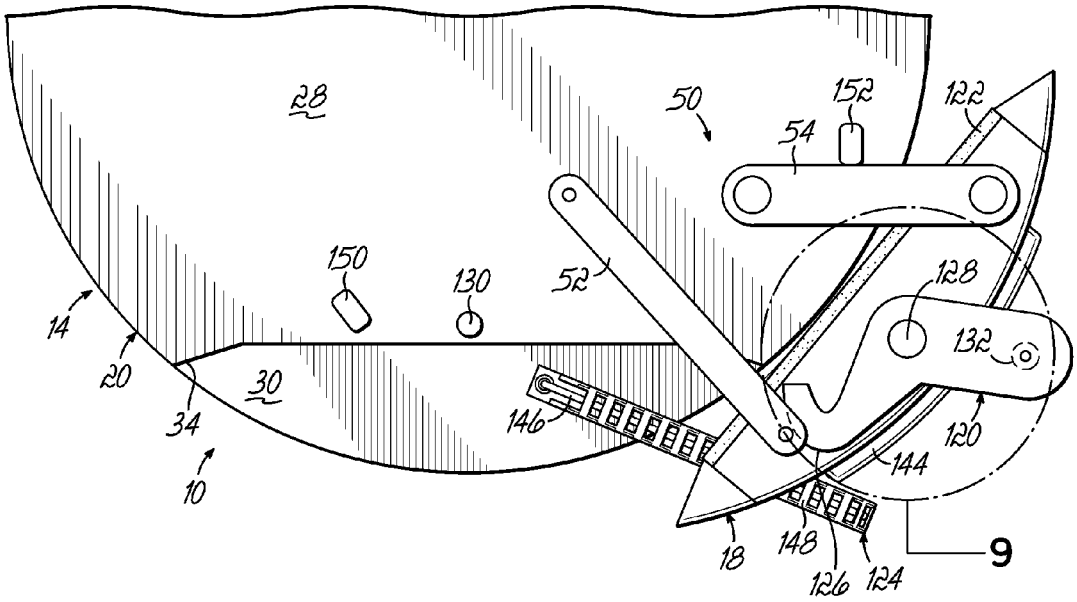
FIG. 8 is a top view of the door and door linkage of FIG. 6, with the door moved to the opened position.
Figure 9:
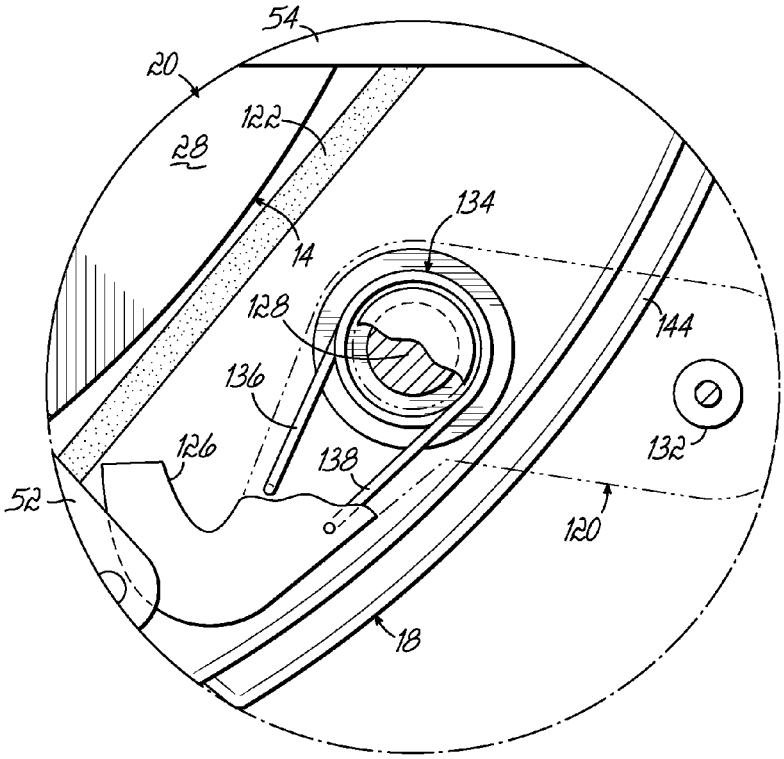
FIG. 9 is a partially cross-sectioned top view of the locking latch of FIG. 8.
Figure 8A:
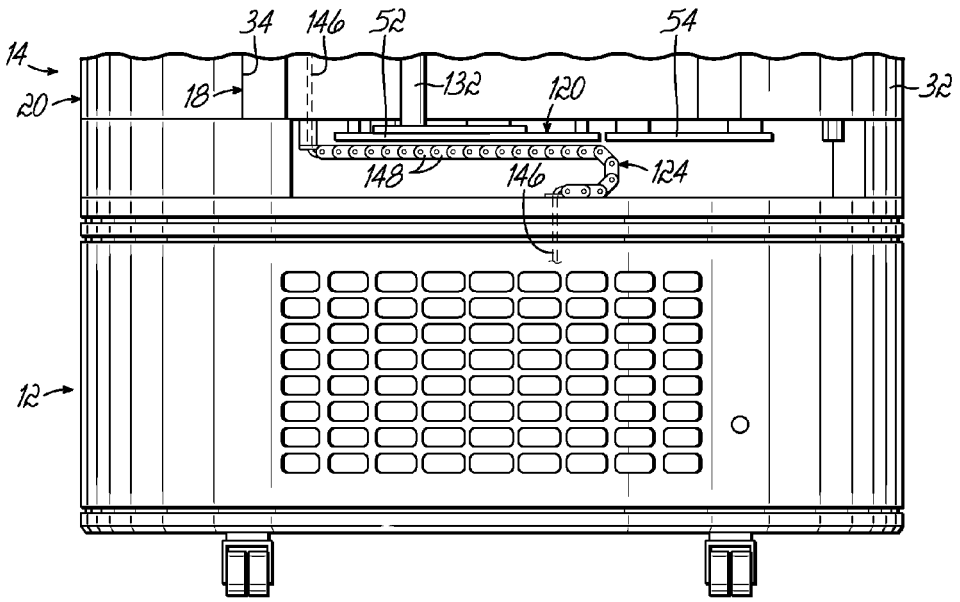
FIG. 8A is a front view of a lower portion of the freezer of FIG. 1, showing a cord guard of the freezer in the closed position of the door.
Figure 8B:
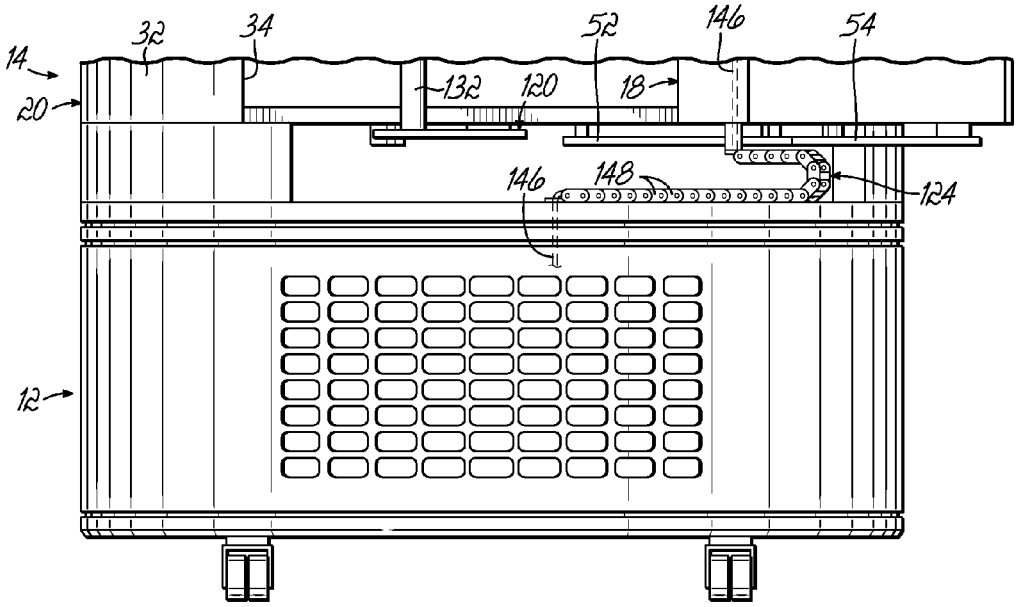
FIG. 8B is a front view of the lower portion of the freezer of FIG. 8A, showing the cord guard in the open position of the door.

Turning to the cord guard 124, the door 18 may further include a user interface 144 for controlling parameters of the refrigeration system 16 via controller 72 as well as motorized drive mechanisms described in further detail below. Thus, the user interface 144 must be connected via electrical cord 146 to the deck 12 of the freezer 10. In order to protect this cord 146 from catching between the door 18 and the cabinet 14 or other shearing forces, the cord 146 extends through the cord guard 124 as shown in FIGS. 8, 8A, and 8B. The cord guard 124 includes a plurality of links 148 in a series similar to a bicycle chain or tank track. As the door 18 moves from the closed position shown in FIG. 8A to the open position shown in FIG. 8B, the cord guard 124 folds upon itself to effectively extend from or retract into the cylindrical profile of the cabinet 14. The cord guard 124 therefore maintains the position of the cord 146 while protecting the cord 146 from pinching or other damage.

In operation, the door 18 moves as follows. From the closed and locked position shown in FIG. 6 (defined by where the first link 52 abuts a first end block 150 located on the top panel 28), a user grabs the handle 132 and rotates it against the bias of spring 134 to disengage the cam latch 126 and the pin follower 130. The sealing gasket 122 then decompresses to force the door 18 to the slightly open position shown in FIG. 7. The user may then push the handle 132 to the right as viewed in FIG. 7 to move the door 18 as enabled by the rotation of the first and second links 52, 54 along the side panel 32 of the outer cabinet housing 20. When the door 18 reaches the fully open position shown in FIG. 8, the second link 54 abuts a second end block 152 located on the top panel 28. Additionally, the cord 146 is held in position connected to the deck 12 and to the door 18 via the extension of cord guard 124. To reclose the door 18, these steps are reversed so as to move the door to the left and then inwardly to engage the cam latch 126 and the pin follower 130, thereby returning to the closed and latched position shown in FIG. 6.

As shown in hidden lines in FIG. 1, it will be understood that the freezer 10 may include a lower door linkage 50 and lower latch mechanism 120 connected to the handle 132, each of which is identical and operates in an identical manner to the similar components described above along the top panel 28 of the freezer 10. Thus, these lower components are not described in further detail herein. Additionally, the freezer 10 may include a motorized door as shown in the alternative embodiment of FIG. 10. In this aspect, the door linkage 50 includes a driven gear 154 connected to one of the first or second links 52, 54 (the second link 54 in FIG. 10), the driven gear 154 engaging an output gear 156 of a door motor 158. As will be readily understood from FIG. 10, the door motor 158 operates to rotate the output gear 156, which drives the driven gear 154, the second link 54, and therefore also the door 18 to move between the open and closed positions. No additional locking latch mechanism 120 is required in this embodiment. It will be understood that the door motor 158 is operatively coupled to the user interface 144 on the door 18 so that the motorized movement of the door 18 can be manipulated at the door 18, similar to the manipulation of the handle 132 in the manual embodiment.

Figure 11:
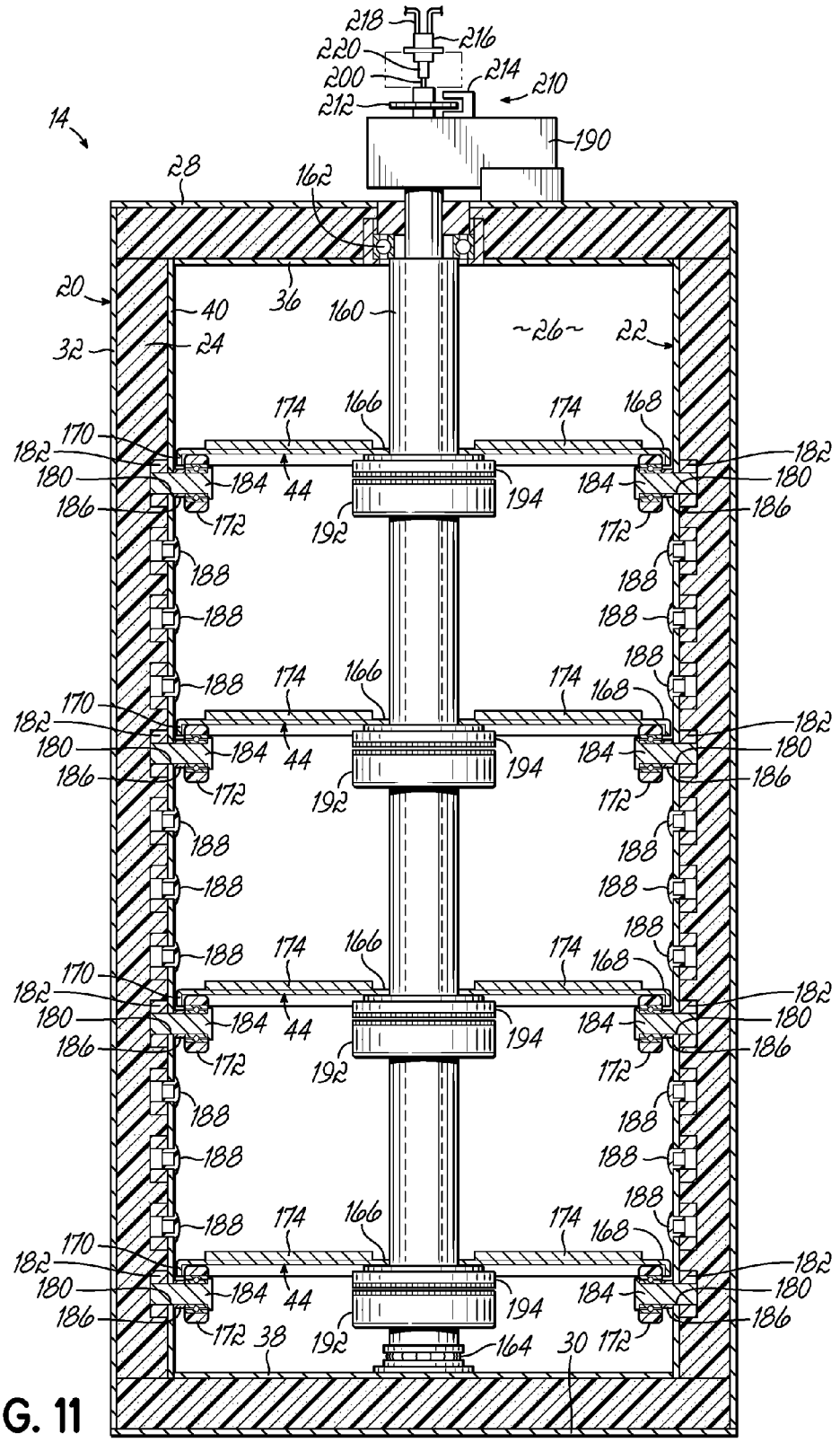
FIG. 11 is a cross-sectional side view of the cabinet of FIG. 1, showing shelf mounting and shelf drive mechanisms.
Figure 12:
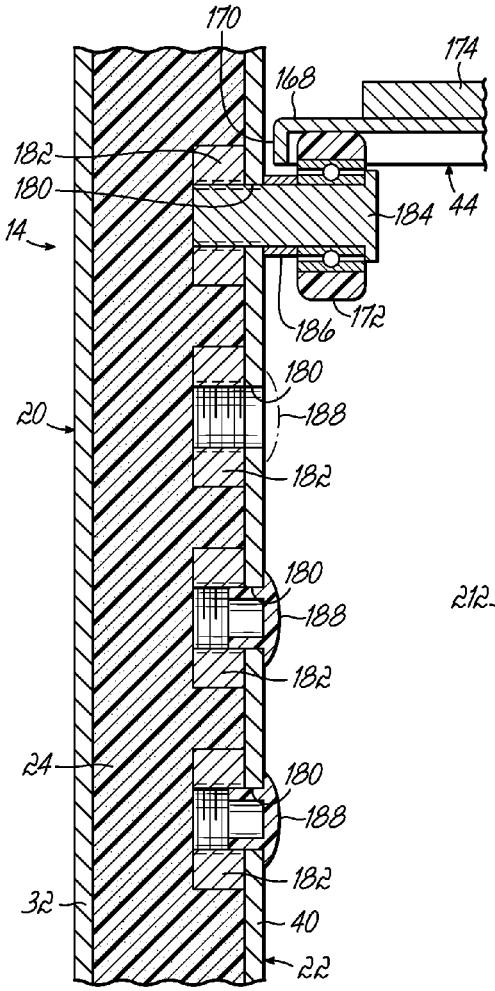
FIG. 12 is a detailed cross-sectional side view of the shelf mounting of FIG. 11.

As previously described in connection with FIG. 2, the cabinet 14 includes a plurality of rotatable shelves 44 mounted within the inner chamber 26 and described in further detail with reference to FIGS. 11-15 below. With particular reference to FIGS. 11 and 12, each shelf 44 is adjustably mounted in various vertical positions along an upstanding, elongated central shaft 160 in the inner chamber 26. The elongated shaft 160 extends between a first thrust bearing 162 located at the top wall 36 of the inner chamber wall 22 and a second thrust bearing 164 located at the bottom wall 38. Each shelf 44 extends radially outwardly from an inner periphery 166 adjacent the elongated shaft 160 to an outer periphery 168 adjacent the side wall 40. The outer periphery 168 of the shelf 44 includes a downwardly turned lip 170 configured to seat over a plurality of roller bearings 172 at the side wall 40. The lip 170 also provides a gripping surface for manual rotation of each shelf 44 when necessary. In this regard, a user may grab the lip 170 of a shelf 44 and rotate the shelf 44 so that an article to be retrieved from the shelf 44 is moved to a location adjacent the inner opening 42 for easier accessibility.

Also shown in FIG. 11 (and FIG. 2), each shelf 44 includes a plurality of vertically oriented dividers 174 extending upwardly and radially outwardly from the top of each shelf 44. These dividers 174 effectively divide the shelf 44 into a plurality of shelf compartments 176 into which one of the pie-shaped racks 46 will be located. Although the dividers 174 are shown as relatively short dividers in the illustrated embodiment, it will be understood that the dividers 174 could be modified to be taller to more fully separate each shelf compartment 176 from adjacent shelf compartments 176. When the racks 46 are in position in the shelf compartments 176, the dividers 174 and the adjacent racks 46 effectively block access to the remainder of the inner chamber 26 and other shelf compartments 176 when one rack 46 is removed through the inner opening 42. It will be understood that the racks 46 may be removed in some shelf compartments 176 when articles to be stored on the shelf 44 are larger than a single shelf compartment 176 or larger than a cassette 48 carried in the racks 46.

With continued reference to FIGS. 11 and 12, the side wall 40 of the inner chamber wall 22 includes multiple vertical series of apertures 180 leading to corresponding series of weld nuts 182 located within the insulated space 24 between the outer cabinet housing 20 and the inner chamber wall 22. Each aperture 180 and weld nut 182 is configured to receive and engage a pin 184 carrying a roller bearing 172. The pin 184 may also carry a spacer 186 configured to set a minimum spacing between the roller bearing 172 and the side wall 40 to ensure room for the downwardly turned lip 170 of a shelf 44 supported by the roller bearing 172. The roller bearing 172 is configured to freely rotate about the pin 184 as the shelf 44 rotates about the elongated shaft 160. When the weld nuts 182 at a particular level are not being used by corresponding roller bearings 172 and pins 184, the apertures 180 may be closed off with plastic caps 188 as shown. To modify the vertical position of a shelf 44, these plastic caps 188 are removed at the desired new level of the shelf 44 and the pins 184 carrying the roller bearings 172 for that shelf 44 are moved to these new weld nuts 182 to support the shelf 44 at that location within the inner chamber 26. Thus, each shelf 44 is adjustably positioned within the inner chamber 26 and is configured to rotate completely independent from the other shelves 44 in the freezer 10.

Although the shelves 44 may be configured to be manually turned when the door 18 is open, the freezer 10 of the exemplary embodiment further includes a shelf motor 190 operatively coupled to the elongated shaft 160 and configured to selectively drive rotation of one or more of the shelves 44. The shelf motor 190 is located adjacent to the top panel 28 of the outer cabinet housing 20 in FIG. 11, but it will be appreciated that the shelf motor 190 may be repositioned in other embodiments without departing from the scope of the invention. The shelf motor 190 can independently rotate the shelves 44 by activating one or more electromagnetic clutch members 192 on the elongated shaft 160 as described in further detail below.

Figure 13:
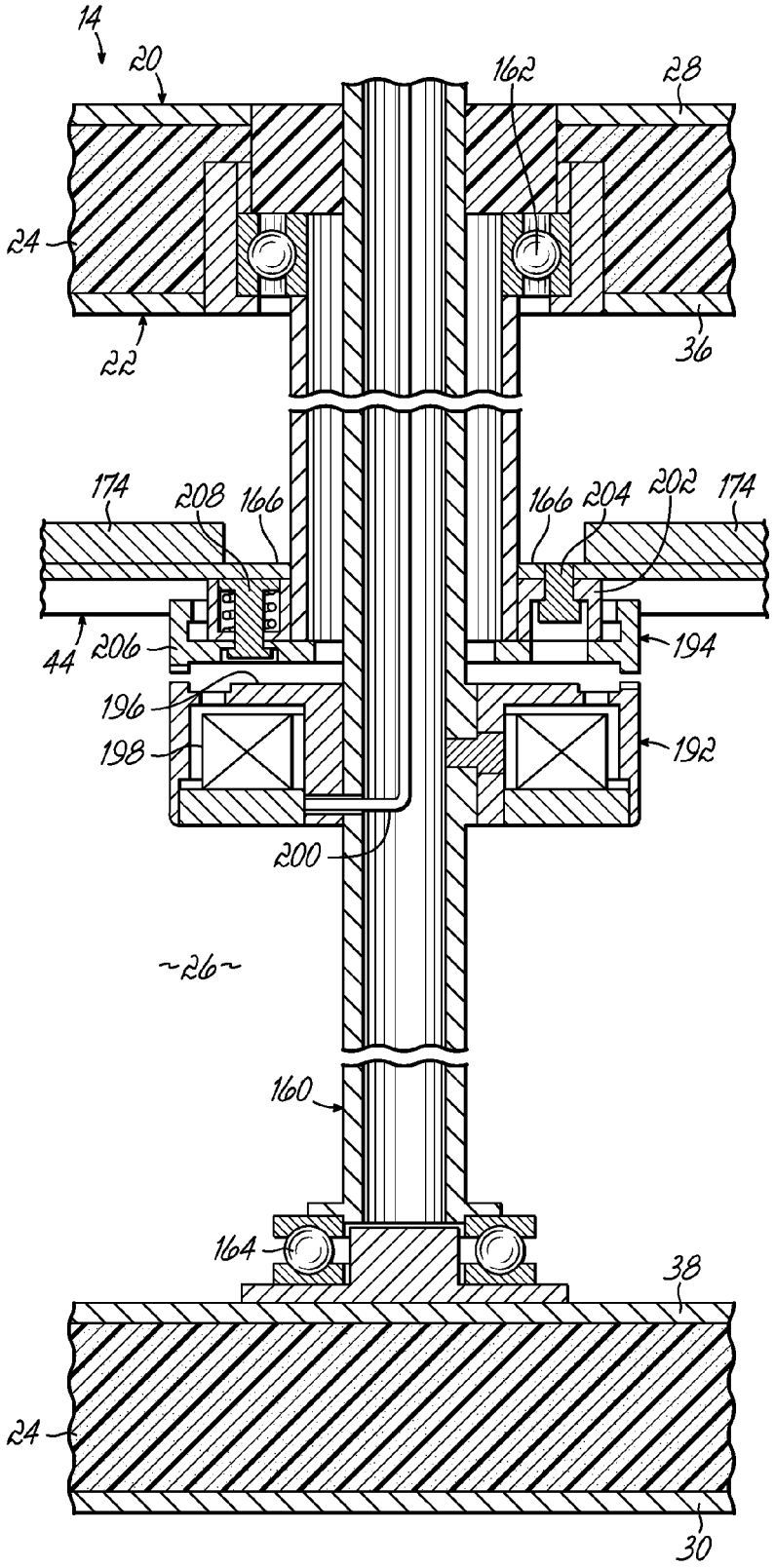
FIG. 13 is a cross-sectional side view of the shelf drive mechanism in a non-actuated position.
Figure 14:
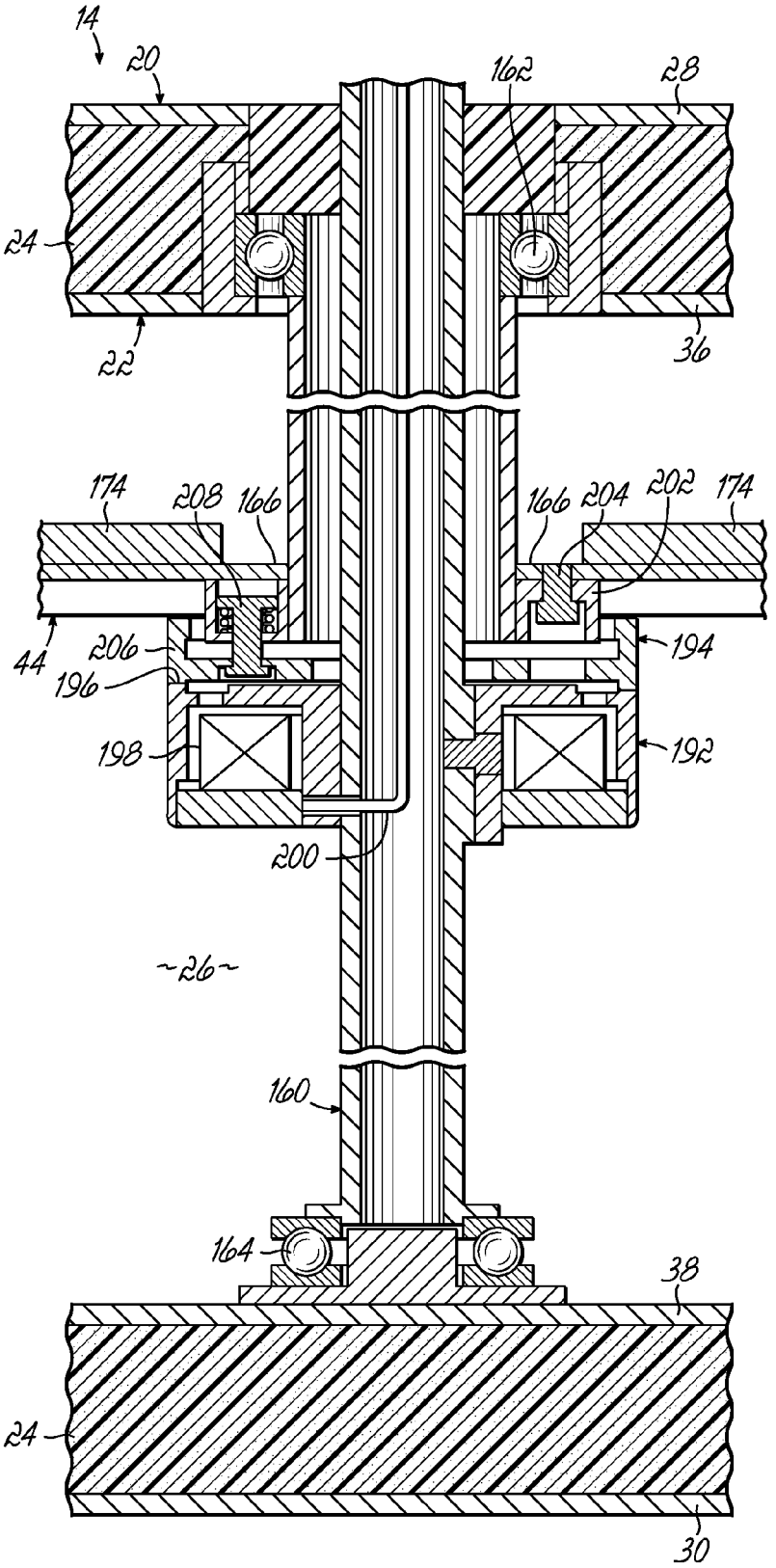
FIG. 14 is a cross-sectional side view of the shelf drive mechanism of FIG. 13 in an actuated position.

With reference to FIGS. 13 and 14, one of the electromagnetic clutch members 192 and a corresponding armature 194 is shown in further detail. In this regard, the electromagnetic clutch member 192 is rigidly coupled to the elongated shaft 160 for rotation therewith. The electromagnetic clutch member 192 includes an upper surface 196 and an electromagnetic coil 198 located underneath the upper surface 196. The electromagnetic coil 198 is connected to an electrical wire 200 extending through the interior of the elongated shaft 160 and operatively coupled to the controller 72 of the freezer 10. The armature 194 includes an upper platform 202 rigidly coupled to the shelf 44 such as by one or more fasteners 204 as shown in FIGS. 13 and 14. The armature 194 also includes a lower platform 206 movably connected to the upper platform 202 by one or more spring-biased connectors 208 (one shown in FIGS. 13 and 14).

In operation, the controller 72 is configured to deliver electrical current through wire 200 to activate the electromagnetic coil 198, which in turn generates a magnetic field that attracts the lower platform 206 of the armature 194 so as to cause the lower platform 206 to move against the spring bias on the connectors 208 into engagement with the upper surface 196 of the electromagnetic clutch member 192 (shown in FIG. 14). To this end, when electrical current is delivered to the electromagnetic clutch member 192, the armature 194 is magnetically attracted and coupled to the electromagnetic clutch member 192 so that the elongated shaft 160 also rotates the armature 194 and the shelf 44. When electrical current is not delivered to the electromagnetic clutch member 192, the armature 194 is disengaged from the electromagnetic clutch member 192 and the shelf 44 does not rotate with the elongated shaft 160 (shown in FIG. 13). Accordingly, the controller 72 is operable to actuate operation of the shelf motor 190 and one or more of the electromagnetic clutch members 192 to rotate the corresponding shelves 44.

Advantageously, the selective motorized rotation of the shelves 44 enables the movement of a desired article or rack 46 within the inner chamber 26 to be moved adjacent to the door 18 prior to the door 18 being opened, thereby limiting the total time that the cabinet 14 must be open and exposed to the external environment. To this end, the freezer 10 includes an indexing sensor 210 operatively communicating with the controller 72 for indexing movements of the elongated shaft 160. As shown in FIG. 11 and more clearly in FIG. 15, the indexing sensor 210 includes a plurality of blades 212 coupled to the elongated shaft 160 and an optical sensor 214 located adjacent the plurality of blades 212. As the elongated shaft 160 rotates, each of the blades 212 passes through the optical sensor 214 so as to interrupt a beam of light (not shown) emitted by the optical sensor 214, and the number of times that the beam of light is interrupted corresponds to the amount of rotation of the elongated shaft 160. Thus, the controller 72 can index certain shelf compartments 176 and determine when those shelf compartments 176 and the associated racks 46 are moved adjacent to the door 18. Furthermore, the controller 72 may receive information or commands on an article to be retrieved from the inner chamber 26 from the user interface 144 on the door 18, and then actuate the shelf motor 190 and the electromagnetic clutch member 192 of the shelf 44 to rotate the shelf 44 (as indexed by the indexing sensor 210) until the article is positioned adjacent to the door 18. Thus, the cylindrical shape of the freezer 10 enables easier and faster retrieval of articles stored within the inner chamber 26, whether the shelves 44 are motorized or not.

Figure 15:
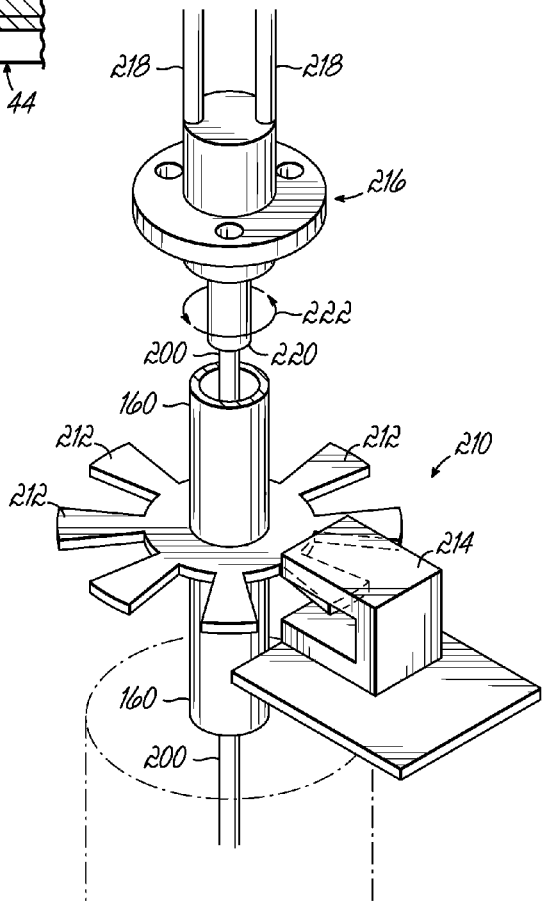
FIG. 15 is a schematic perspective view of a rotational movement sensor associated with the shelf drive mechanism of FIG. 13.

With continued reference to FIG. 15, a slip ring 216 located above the indexing sensor 210 is shown. The slip ring 216 connects the electrical wires 200 (only one shown in FIG. 15) connected to the electromagnetic clutch members 192 to a stationary power supply indicated by stationary electrical leads 218. The slip ring 216 includes a mounting 220 for the electrical wires 200 that freely rotates as shown by arrow 222 with the elongated shaft 160 without interrupting the controllable power supply to each of the electrical wires 200. For example, the slip ring 216 may be a SRA-73540 slip ring capsule commercially available from Moog, Inc. of East Aurora, N.Y. Thus, the power supplied to actuate each of the electromagnetic clutch members 192 may be reliably delivered despite the rotational movement of the electromagnetic clutch members 192.

Figure 16:
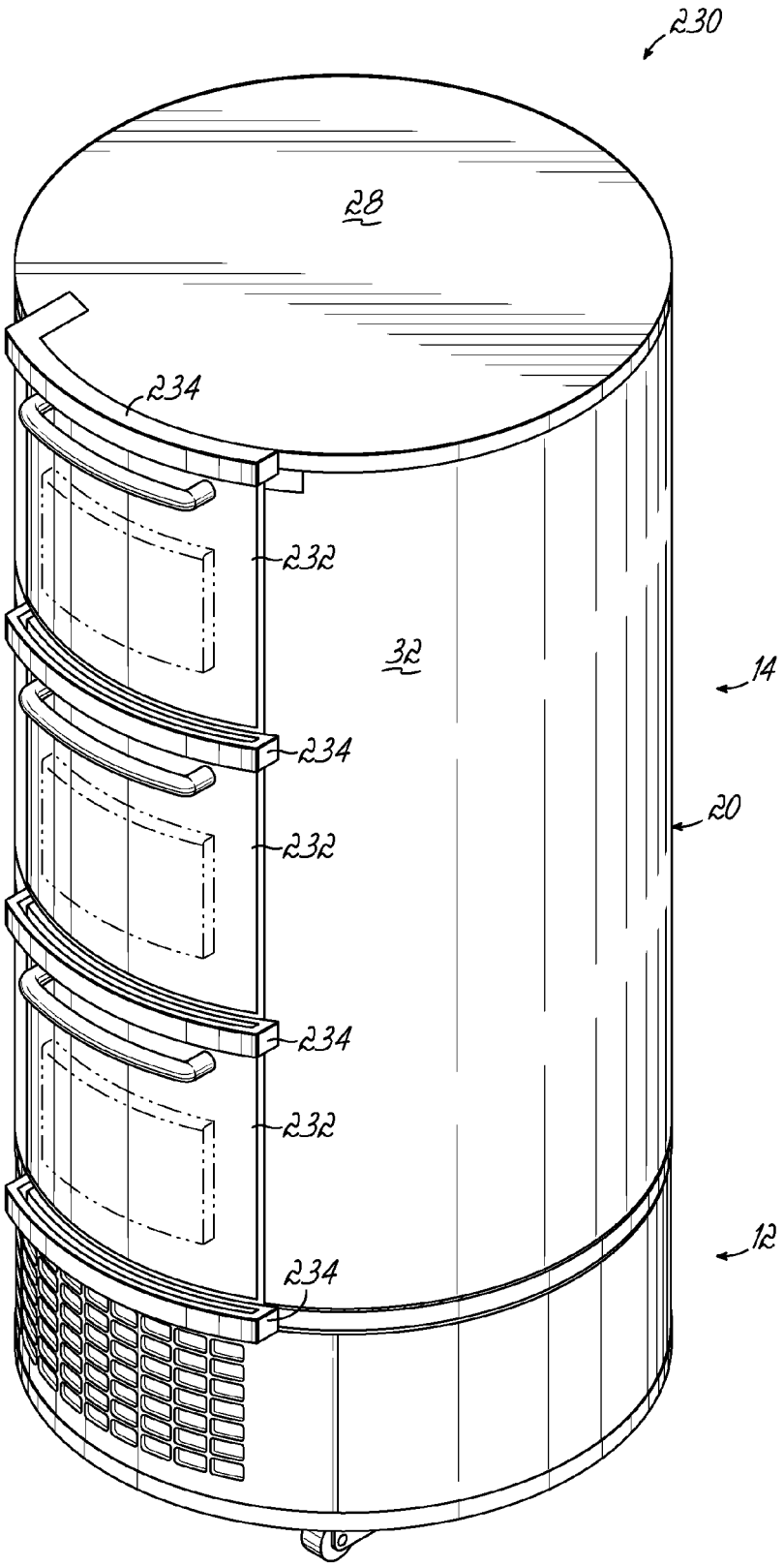
FIG. 16 is a perspective view of another embodiment of a freezer including a cylindrical cabinet according to the present invention.

With reference to FIG. 16, an alternative embodiment of a freezer 230 including a cylindrical cabinet 14 is shown. All elements of the freezer 230 of this embodiment are identical to those in the previous freezer 10 with one exception: the freezer 230 of this embodiment includes a plurality of independently slidable arcuate doors 232 coupled to the cabinet 14. Each of the plurality of doors 232 slides along a circumferential path defined by upper and lower rails 234 bounding each side of the doors 232. This sliding movement follows along the side panel 32 of the outer cabinet housing 20 such that the total clearance or floor space necessary for movement of the doors 232 is minimized. In this embodiment of the freezer 230, only the door 232 located next to the shelf 44 containing the article to be retrieved needs to be opened when opening and closing the cabinet 14. As a result, the amount of exposure of the inner chamber 26 to the external environment is further reduced.

In summary, the cylindrical shape of the cabinet 14 and the design of the doors 18, 232 collectively enable a maximized storage space within the inner chamber 26 for the floor space required. Additionally, the cylindrical shape also enables rotation of shelves 44 within the inner chamber 26, thereby permitting easy access to articles in any location on the shelves 44. Furthermore, when the shelves 44 are configured for motorized rotation, the articles to be retrieved may be rotated to a location adjacent the door 18, 232 before the door 18, 232 is opened so that the amount of time the inner chamber 26 is exposed to the external environment is minimized. Each of the shelves 44 may be repositioned or removed for easy reconfiguration and cleaning of the inner chamber 26. Thus, the cylindrical freezer 10 addresses many of the problems with conventional freezers such as ultra-low temperature freezers.

While the present invention has been illustrated by a description of exemplary embodiments and while these embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A freezer, comprising:

a deck;

a cabinet supported above the deck and having a cabinet housing and a chamber wall located within the cabinet housing and defining an inner chamber, the cabinet housing having a generally cylindrical shape along the cabinet's length and defining an outer opening for providing access to the inner chamber;

a door supported by the cabinet housing and being configured to move between open and closed positions relative to the outer opening;

a two-stage cascade refrigeration system mounted at least partially within the deck and comprising:

a first refrigeration stage defining a first fluid circuit for circulating a first refrigerant, the first refrigeration stage having a first compressor, a first expansion device, and an evaporator in fluid communication with the first fluid circuit, with the evaporator being in thermal communication with the chamber wall to refrigerate the inner chamber;

a second refrigeration stage defining a second fluid circuit for circulating a second refrigerant, the second refrigeration stage having a second compressor, a condenser and a second expansion device in fluid communication with the second fluid circuit; and a heat exchanger in fluid communication with the first and second fluid circuits, wherein the freezer operates to provide a temperature within the inner chamber in a range from about −30° C. to about −80° C.;

an upstanding, elongated shaft located within the inner chamber;

a plurality of vertically spaced, rotatable shelves operatively coupled to the elongated shaft and configured to support articles within the inner chamber;

a shelf motor operatively coupled to the elongated shaft and configured to rotate the shaft and at least one of the plurality of shelves;

an electromagnetic clutch member coupled to the elongated shaft and associated with at least one of the plurality of shelves; and an armature coupled to the at least one shelf, the electromagnetic clutch member operable to magnetically attract and engage the armature to enable rotation of the at least one shelf with the elongated shaft.

2. The freezer of claim 1, wherein the heat exchanger and the first expansion device are located in the space defined between the cabinet housing and the chamber wall.

3. The freezer of claim 1, wherein the cabinet housing includes a top panel and a side panel having a generally cylindrical shape and defining the outer opening for providing access to the inner chamber, and wherein the cabinet wall includes a top wall, a bottom wall, and a side wall extending between the top wall and the bottom wall, the side wall having a generally cylindrical shape along the side wall's length and defining an inner opening for providing access to the inner chamber from the outer opening.

4. The freezer of claim 3, wherein the evaporator is located in a space defined between the cabinet housing and the chamber wall, and further wherein the evaporator is located adjacent to and in thermal communication with the top wall, the side wall, and the bottom wall.

5. The freezer of claim 4, wherein the evaporator includes an evaporator coil that follows a sinusoidal pattern adjacent to the side wall and follows a coil pattern adjacent to each of the top wall and the bottom wall.

6. The freezer of claim 1, further comprising:

a latch mechanism configured to lock the door in the closed position and to unlock the door to enable movement of the door from the closed position to the open position.

7. The freezer of claim 1, further comprising:

a latch mechanism configured to lock the door in the closed position and to unlock the door to enable movement of the door from the closed position to the open position, wherein the latch mechanism includes a spring-biased cam latch pivotally coupled to the door and a pin follower operatively coupled to the cabinet housing, the cam latch being configured to engage the pin follower when the latch mechanism locks the door in the closed position.

8. The freezer of claim 7, further comprising:

a handle operatively coupled to the cam latch and configured to move the cam latch out of engagement with the pin follower against the spring bias when the door is to be moved from the closed position to the open position.

9. The freezer of claim 8, wherein the pin follower of the latch mechanism is coupled to the top panel of the cabinet housing, and the latch mechanism further includes a lower cam latch coupled to the handle and a lower pin follower coupled to the bottom wall of the chamber wall, the lower cam latch being configured to engage the lower pin follower when the latch mechanism locks the door in the closed position.

10. The freezer of claim 7, wherein the door includes a sealing gasket located proximate the outer opening, the sealing gasket being compressed into sealed engagement with the door and the outer cabinet housing when the latch mechanism locks the door in the closed position.

11. The freezer of claim 10, wherein the sealing gasket is configured to decompress when the cam latch is disengaged from the pin follower so as to move the door away from the outer opening and enable movement of the door to the open position.

12. The freezer of claim 1, wherein the door has a generally arcuate shape, the cabinet housing includes a side panel having a generally cylindrical shape and defining the outer opening, and the freezer further comprises:

first and second links each pivotally coupled to the door and the cabinet housing such that the door moves generally circumferentially along the side panel of the cabinet housing during travel of the door between the open and closed positions.

13. The freezer of claim 12, further comprising:

a door motor operatively coupled to one of the first and second links and configured to drive the door between the open and closed positions.

14. The freezer of claim 13, further comprising:

a user interface panel located on the door and operatively coupled to the door motor to control operation of the door motor.

15. The freezer of claim 1, further comprising:

a door motor operatively coupled to the door and configured to drive the door between the open and closed positions; and a user interface panel located on the door and operatively coupled to the door motor to control operation of the door motor, wherein the user interface panel is electrically connected to a power supply by a cord extending from the door into the cabinet housing, the cord extending through a cord guard that extends and retracts within the cabinet housing to move with the door between the open and closed positions, wherein the cord guard includes a plurality of chain links in a series with the cord extending through the chain links, with the chain links being pivotable relative to each other to enable the cord guard to fold upon itself during extension and retraction of the cord guard relative to the cabinet housing.

16. The freezer of claim 1, wherein the freezer further comprises:

a plurality of doors having respective open and closed positions and providing access to different portions of the inner chamber through the outer opening, the plurality of doors being movable between their respective open and closed positions independent of one another.

17. The freezer of claim 16, wherein each of the plurality of doors is slidable between their respective open and closed positions along a side panel of the cabinet housing.

18. The freezer of claim 1, wherein each of the plurality of shelves is removably supported by the chamber wall such that a position of each shelf is vertically adjustable.

19. The freezer of claim 18, further comprising:

a plurality of roller bearings supported by the chamber wall, wherein each shelf is rotatably supported by the plurality of roller bearings.

20. The freezer of claim 19, wherein a side wall of the chamber wall includes a plurality of pin apertures and each of the plurality of roller bearings includes a respective pin, and further wherein each of the plurality of pin apertures is configured to receive a respective pin of the plurality of roller bearings.

21. The freezer of claim 1, wherein each shelf is independently rotatable relative to another shelf.

22. The freezer of claim 1, further comprising:

a plurality of electromagnetic clutch members coupled to the elongated shaft and associated with the plurality of shelves;

a plurality of armatures coupled to the plurality of shelves; and a controller operatively coupled to the shelf motor and the electromagnetic clutch members, wherein the controller is operable to actuate the shelf motor and one of the electromagnetic clutch members to rotate the elongated shaft and the shelf associated with the actuated electromagnetic clutch member.

23. The freezer of claim 22, further comprising:

a user interface panel operatively coupled to the controller and configured to receive information from a user related to an article to be accessed within the inner chamber, wherein the controller is configured to rotate a shelf of the plurality of shelves on which the article is supported to a position accessible by the user through the outer opening.

24. The freezer of claim 23, wherein the user interface panel is electrically connected to a power supply by a cord extending from the door into the cabinet housing, the cord extending through a cord guard that extends and retracts within the cabinet housing to move with the door between the open and closed positions.

25. The freezer of claim 23, further comprising:

an optical sensor operatively coupled to the controller and responsive to rotation of the elongated shaft so that at least one of the plurality of shelves is selectively indexable relative to the outer opening.

26. The freezer of claim 1, further comprising:

a plurality of vertically oriented dividers extending radially outwardly from adjacent the elongated shaft and dividing at least one of the plurality of shelves into a plurality of shelf compartments.

27. The freezer of claim 26, wherein the plurality of dividers is configured so as to provide selective access to one of the plurality of shelf compartments associated with one of the plurality of shelves through the outer opening while blocking access to adjacent shelf compartments associated with the one of the plurality of shelves through the outer opening.

28. The freezer of claim 27, further comprising:

a plurality of racks configured to each be insertable into a respective one of the plurality of shelf compartments.

29. The freezer of claim 1, wherein the door includes a generally arcuate shape, the cabinet housing includes a side panel having a generally cylindrical shape and defining the outer opening, and the freezer further comprises:

first and second links each pivotally coupled to the door and also pivotally coupled to the cabinet housing to cause the door to move generally circumferentially along the side panel of the cabinet housing during travel of the door between the open and closed positions, the first and second links being independent from one another and spaced apart from one another so as to enable an entirety of the door to remain adjacent to the side panel during circumferential movement of the door between the open and closed positions.

30. The freezer of claim 29, further comprising:

a door motor operatively coupled to one of the first and second links and configured to drive the door between the open and closed positions.

31. The freezer of claim 30, further comprising:

a user interface panel located on the door and operatively coupled to the door motor to control operation of the door motor.

32. The freezer of claim 31, wherein the user interface panel is electrically connected to a power supply by a cord extending from the door into the cabinet housing, the cord extending through a cord guard that extends and retracts within the cabinet housing to move with the door between the open and closed positions.

33. The freezer of claim 29, further comprising:

a latch mechanism configured to lock the door in the closed position and to unlock the door to enable movement of the door from the closed position to the open position.

34. The freezer of claim 33, wherein the latch mechanism includes a spring-biased cam latch pivotally coupled to the door and a pin follower operatively coupled to the cabinet housing, the cam latch being configured to engage the pin follower when the latch mechanism locks the door in the closed position.

35. The freezer of claim 34, further comprising:

a handle operatively coupled to the cam latch and configured to move the cam latch out of engagement with the pin follower against the spring bias when the door is to be moved from the closed position to the open position.

* * * * *

UNITED STATES PATENT AND TRADEMARK OFFICE

CERTIFICATE OF CORRECTION

PATENT NO. : 8,925,346 B2
APPLICATION NO. : 13/368032
DATED : January 6, 2015
INVENTOR(S) : Mahesh Natarajan et al.

It is certified that error appears in the above-identified patent and that said Letters Patent is hereby corrected as shown below:

Title Page

(75) Inventors, delete "Khadatkar" and add -- Khadtkar --

In the Specification

At Column 6, line 8, delete "links 52, 54 in accordance with the principals of a four bar" and add -- links 52, 54 in accordance with the principles of a four bar --

At Column 12, line 16, delete "is shown in further detail. In this regard, the electromagnetic" and add -- are shown in further detail. In this regard, the electromagnetic --

At Column 13, line 63, delete "not the intention of the applicant to restrict or in any way limit c" and add -- not the intention of the Applicants to restrict or in any way limit --

In the Claims

At claim 1, Column 14, lines 3-4, delete "details without departing from the spirit or scope of applicant's general inventive concept." and add -- details without departing from the spirit or scope of Applicants' general inventive concept. --

At claim 17, Column 16, line 18, delete "doors is slidable between their respective open and closed" and add -- doors is slidable between its respective open and closed --

Signed and Sealed this
Ninth Day of June, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,925,346 B2
APPLICATION NO. : 13/368032
DATED : January 6, 2015
INVENTOR(S) : Mahesh Natarajan et al.

It is certified that error appears in the above-identified patent and that said Letters Patent is hereby corrected as shown below:

Title Page

(75) Inventors, delete "Khadatkar" and add -- Khadtkar --

In the Specification

At Column 6, line 8, delete "links 52, 54 in accordance with the principals of a four bar" and add -- links 52, 54 in accordance with the principles of a four bar --

At Column 12, line 16, delete "is shown in further detail. In this regard, the electromagnetic" and add -- are shown in further detail. In this regard, the electromagnetic --

At Column 13, line 63, delete "not the intention of the applicant to restrict or in any way limit c" and add -- not the intention of the Applicants to restrict or in any way limit --

At Column 14, lines 3-4, delete "details without departing from the spirit or scope of applicant's general inventive concept." and add -- details without departing from the spirit or scope of Applicants' general inventive concept. --

In the Claims

At claim 17, Column 16, line 18, delete "doors is slidable between their respective open and closed" and add -- doors is slidable between its respective open and closed --

This certificate supersedes the Certificate of Correction issued June 9, 2015.

Signed and Sealed this
Twelfth Day of January, 2016

Michelle K. Lee

Michelle K. Lee
*Director of the United States Patent and Trademark Office*